US010039374B2

(12) United States Patent
Abraham et al.

(10) Patent No.: US 10,039,374 B2
(45) Date of Patent: Aug. 7, 2018

(54) MULTI-TIERED WORKSTATION ASSEMBLY

(71) Applicant: Steelcase Inc., Grand Rapids, MI (US)

(72) Inventors: James Edward Abraham, Grandville, MI (US); Justin Gillespie, Georgetown Towns, MI (US); Joseph Iacovoni, Caledonia, MI (US); Kevin Gillhespy, Wyoming, MI (US); Mark McKenna, East Grand Rapids, MI (US)

(73) Assignee: STEELCASE INC., Grand Rapids, MI (US)

( * ) Notice: Subject to any disclaimer, the term of this patent is extended or adjusted under 35 U.S.C. 154(b) by 0 days.

(21) Appl. No.: 15/595,179

(22) Filed: May 15, 2017

(65) Prior Publication Data

US 2017/0325583 A1 Nov. 16, 2017

Related U.S. Application Data

(60) Provisional application No. 62/339,159, filed on May 20, 2016, provisional application No. 62/336,042, filed on May 13, 2016.

(51) Int. Cl.

| | |
|---|---|
| ***A47B 13/00*** | (2006.01) |
| ***A47B 13/08*** | (2006.01) |
| ***A47B 13/02*** | (2006.01) |
| ***A47B 13/10*** | (2006.01) |

(52) U.S. Cl.

CPC ..... *A47B 13/088* (2013.01); *A47B 13/02* (2013.01); *A47B 13/10* (2013.01)

(58) Field of Classification Search

CPC .. A47B 13/088; A47B 13/10; A47B 2009/006

USPC ..... 108/92, 93, 106, 107, 108, 109

See application file for complete search history.

(56) References Cited

U.S. PATENT DOCUMENTS

| | | | |
|---|---|---|---|
| 8,934 | A | 5/1852 | Betts |
| 99,246 | A | 1/1870 | Shannon |
| 114,515 | A | 5/1871 | Beek |
| 285,995 | A | 10/1883 | Gesking |

(Continued)

FOREIGN PATENT DOCUMENTS

| | | | |
|---|---|---|---|
| CA | 2240373 | A1 | 12/1999 |
| CN | 1170554 | A | 1/1998 |

(Continued)

OTHER PUBLICATIONS

PCT International Search Report, PCT/US2008/064457, dated Jan. 29, 2009.

(Continued)

*Primary Examiner* — Daniel J Rohrhoff

(74) *Attorney, Agent, or Firm* — Quarles & Brady LLP

(57) ABSTRACT

A multi-tiered work arrangement includes stacked horizontal planar surfaces that have footprints that enable stacking of the planar surfaces to provide work surfaces that are easily accessible to a user in both a sitting and a standing position. A first work surface can have a wide end and a narrow end, and a second work surface can have corresponding narrow and wide ends. The wide end of the first planar surface is substantially equivalent in length to the narrow end of the second planar surface such that the work surfaces can be stacked in use, providing two unobstructed work surfaces at different heights.

18 Claims, 8 Drawing Sheets

(56) References Cited

U.S. PATENT DOCUMENTS

| | | | |
|---|---|---|---|
| 327,413 | A | 9/1885 | Rohrbach |
| 418,084 | A | 12/1889 | Swinnerton |
| 443,108 | A | 12/1890 | Owen |
| 451,599 | A | 5/1891 | Meigs |
| 452,971 | A | 5/1891 | Kidder |
| 501,935 | A | 7/1893 | Harsha |
| 543,053 | A | 7/1895 | Ripking |
| 571,652 | A | 11/1896 | Dodd |
| 604,215 | A | 5/1898 | Quarry |
| 636,548 | A | 11/1899 | Owen |
| 654,922 | A | 7/1900 | Schipkowsky |
| 658,983 | A | 10/1900 | Francis |
| 659,987 | A | 10/1900 | Ray |
| 688,104 | A | 12/1901 | Lohrman |
| 698,558 | A | 4/1902 | Rosenbaum |
| 710,376 | A | 9/1902 | Smith |
| 794,809 | A | 7/1905 | Marsh |
| 795,957 | A | 8/1905 | Cartland |
| 859,987 | A | 7/1907 | Smith |
| 860,150 | A | 7/1907 | Plym |
| 907,507 | A | 12/1908 | Kerr |
| 978,299 | A | 12/1910 | Jacobs |
| 983,903 | A | 2/1911 | Horton |
| 1,014,848 | A | 1/1912 | Reinert |
| 1,050,409 | A | 1/1913 | Wadsworth et al. |
| 1,201,305 | A | 10/1916 | Jones |
| 1,251,719 | A | 2/1918 | Wege |
| 1,258,773 | A | 3/1918 | Hoffmann et al. |
| 1,277,550 | A | 9/1918 | Connell |
| 1,340,562 | A | 5/1920 | Sandmann |
| 1,386,469 | A | 8/1921 | Gomoll |
| 1,395,166 | A | 10/1921 | Tomlinson |
| 1,398,611 | A | 11/1921 | Van Alstyn |
| 1,411,260 | A | 4/1922 | Baker et al. |
| 1,421,929 | A | 7/1922 | Floreskul |
| 1,448,642 | A | 3/1923 | Tomlinson |
| 1,454,467 | A | 5/1923 | Crooks |
| 1,514,512 | A | 11/1924 | Fisher |
| 1,527,094 | A | 2/1925 | Tomlinson |
| 1,542,693 | A | 6/1925 | Gordon |
| 1,547,301 | A | 7/1925 | Cordes |
| 1,638,612 | A | 8/1927 | Baus |
| 1,643,101 | A | 9/1927 | Thompson |
| 1,656,868 | A | 1/1928 | Davis et al. |
| 1,696,456 | A | 12/1928 | Sebring |
| 1,706,388 | A | 3/1929 | Ashkenas |
| 1,766,077 | A | 6/1930 | Jensen |
| 1,770,167 | A | 7/1930 | Hoyer Jr., et al. |
| 1,780,118 | A | 10/1930 | D'Humy |
| 1,785,463 | A | 12/1930 | Strongson |
| 1,786,823 | A | 12/1930 | Carrington et al. |
| 1,792,406 | A | 2/1931 | Tomlinson |
| 1,800,685 | A | 4/1931 | Griffis |
| 1,810,618 | A | 6/1931 | Nelson |
| 1,831,162 | A | 11/1931 | Crowell |
| 1,845,142 | A | 2/1932 | Friesner |
| 1,852,749 | A | 4/1932 | Hiner |
| 1,854,248 | A | 4/1932 | Cairney |
| 1,963,393 | A | 6/1934 | Woodall |
| 1,965,785 | A | 7/1934 | Vallone |
| 1,992,574 | A | 2/1935 | Jenkins |
| D95,588 | S | 5/1935 | Holsman |
| 2,002,128 | A | 5/1935 | Reidenbaugh |
| 2,005,593 | A | 6/1935 | Onions et al. |
| 2,017,844 | A | 10/1935 | Ferney |
| 2,018,250 | A | 10/1935 | Cohan |
| 2,031,848 | A | 2/1936 | Ogden |
| 2,056,356 | A | 10/1936 | Logan |
| 2,089,059 | A | 8/1937 | Harley |
| 2,110,466 | A | 3/1938 | Louis |
| 2,115,239 | A | 4/1938 | Stain |
| 2,118,099 | A | 5/1938 | Mirk |
| 2,119,319 | A | 5/1938 | D'Esopo |
| 2,156,633 | A | 5/1939 | La Ducer |
| 2,179,395 | A | 11/1939 | Yerrick |
| 2,182,703 | A | 12/1939 | Rainwater |
| 2,189,389 | A | 2/1940 | Baker |
| 2,191,701 | A | 2/1940 | Wood |
| 2,201,435 | A | 5/1940 | Guyton |
| 2,202,476 | A | 5/1940 | Baker |
| 2,202,684 | A | 5/1940 | Baker |
| 2,223,023 | A | 11/1940 | Weilemann |
| 2,240,484 | A | 5/1941 | Anderson |
| 2,276,635 | A | 3/1942 | Weber |
| 2,287,079 | A | 6/1942 | Anderson |
| 2,299,443 | A | 10/1942 | Walmsley |
| 2,345,913 | A | 4/1944 | Bishop |
| 2,359,109 | A | 9/1944 | Hormes |
| 2,362,567 | A | 11/1944 | La Rue |
| 2,380,379 | A | 7/1945 | Attwood |
| D150,242 | S | 7/1948 | McDonald |
| 2,479,416 | A | 8/1949 | Schnurer |
| 2,497,278 | A | 2/1950 | Soderlund |
| 2,506,844 | A | 5/1950 | Smith |
| 2,511,949 | A | 6/1950 | Simon |
| 2,522,149 | A | 9/1950 | Tunstall |
| 2,530,474 | A | 11/1950 | Lutes |
| 2,557,766 | A | 6/1951 | Ronfeldt |
| 2,570,000 | A | 10/1951 | Lowry |
| 2,605,203 | A | 7/1952 | Silver |
| 2,620,024 | A | 12/1952 | Rietman |
| 2,640,644 | A | 6/1953 | Hennessey et al. |
| 2,664,331 | A | 12/1953 | Glotfelter |
| 2,675,863 | A | 4/1954 | Lee |
| 2,683,639 | A | 7/1954 | Brenny |
| 2,735,519 | A | 2/1956 | Frischmann |
| D177,215 | S | 3/1956 | Collins |
| 2,793,926 | A | 5/1957 | Deaton |
| 2,821,450 | A | 1/1958 | Knoll |
| 2,825,614 | A | 3/1958 | Card |
| 2,834,478 | A | 5/1958 | Macdonald |
| 2,840,243 | A | 6/1958 | Brinker |
| 2,845,187 | A | 7/1958 | Bianchi |
| 2,900,085 | A | 8/1959 | Levy |
| 2,903,316 | A | 9/1959 | Schmidt |
| 2,905,114 | A | 9/1959 | Olson |
| 2,921,607 | A | 1/1960 | Caveney |
| 2,930,665 | A | 3/1960 | Budai |
| 2,937,765 | A | 5/1960 | Shank |
| 2,942,924 | A | 6/1960 | Stangert |
| 2,944,861 | A | 7/1960 | Lessin |
| 2,963,031 | A | 12/1960 | Carroll |
| 2,965,161 | A | 12/1960 | Knoll |
| 2,975,908 | A | 3/1961 | Huet |
| 2,976,097 | A | 3/1961 | Devine |
| 2,981,583 | A | 4/1961 | Eisenberg |
| 2,988,412 | A | 6/1961 | Vannice |
| 2,993,603 | A | 7/1961 | Fohn |
| 3,000,682 | A | 9/1961 | Loew et al. |
| 3,001,755 | A | 9/1961 | Doyle |
| 3,017,153 | A | 1/1962 | Johnson |
| 3,027,212 | A | 3/1962 | Pearson |
| 3,027,214 | A | 3/1962 | Curatolo |
| 3,031,244 | A | 4/1962 | Stopek |
| 3,036,864 | A | 5/1962 | Arai |
| 3,041,109 | A | 6/1962 | Eames |
| 3,045,961 | A | 7/1962 | Cygan |
| 3,059,825 | A | 10/1962 | Thomas |
| 3,083,007 | A | 3/1963 | Campfield |
| 3,098,239 | A | 7/1963 | Nader |
| 3,117,534 | A | 1/1964 | Martland |
| 3,127,216 | A | 3/1964 | Clouse |
| 3,167,352 | A | 1/1965 | Johnson |
| 3,170,742 | A | 2/1965 | Berkowitz |
| 3,172,711 | A | 3/1965 | Gillotte |
| 3,180,459 | A | 4/1965 | Liskey |
| 3,181,923 | A | 5/1965 | Guillon |
| 3,189,140 | A | 6/1965 | Luss |
| 3,197,822 | A | 8/1965 | Herrschaft |
| 3,200,962 | A | 8/1965 | Davelaar |
| 3,213,580 | A | 10/1965 | Mark |
| 3,217,673 | A | 11/1965 | Knoblock |
| 3,233,942 | A | 2/1966 | Creutz |
| 3,235,218 | A | 2/1966 | Graham |

(56) References Cited

U.S. PATENT DOCUMENTS 3,238,004 A 3/1966 Goebel
3,241,885 A 3/1966 Deaton
3,249,351 A 5/1966 Smith
3,252,469 A 5/1966 Peake
3,255,467 A 6/1966 Kowalski
3,284,874 A 11/1966 Stein
3,289,676 A 12/1966 Saunders
3,295,764 A 1/1967 Geary
3,298,743 A 1/1967 Albinson
3,301,597 A 1/1967 Bereday
3,321,253 A 5/1967 Everburg
3,326,147 A 6/1967 Toney
3,339,502 A 9/1967 Fyffe
3,364,882 A 1/1968 Merrick
3,367,290 A 2/1968 Barecki
3,370,389 A 2/1968 Macaluso
3,388,711 A 6/1968 Huddle
3,404,930 A 10/1968 Cafiero
3,406,645 A 10/1968 Monroe
3,413,053 A 11/1968 Featherston
3,425,108 A 2/1969 Cerutti et al.
3,428,108 A 2/1969 Singer
3,428,688 A 2/1969 Ferdinand et al.
3,437,737 A 4/1969 Wagner
3,438,687 A 4/1969 Wikey
3,441,146 A 4/1969 Summers
3,456,833 A 7/1969 Cornelius
3,464,372 A 9/1969 Fiterman et al.
3,475,769 A 11/1969 Fasanella
3,489,290 A 1/1970 Larson
3,490,824 A 1/1970 Bartlett et al.
3,497,081 A 2/1970 Field
3,497,279 A 2/1970 Chovanec
3,498,239 A 3/1970 Bartlett et al.
3,511,193 A 5/1970 Schild
3,514,170 A 5/1970 Shewchuk
3,517,822 A 6/1970 Wagner
3,517,963 A 6/1970 Woods et al.
3,521,579 A 7/1970 Stafford
3,528,559 A 9/1970 Miller
3,529,880 A 9/1970 Christen
3,552,579 A 1/1971 Simon et al.
3,556,586 A 1/1971 Beardmore
3,563,624 A 2/1971 Stice
3,565,152 A 2/1971 Cohn, Jr. et al.
3,566,566 A 3/1971 Janic
3,570,682 A 3/1971 Elliott
3,570,798 A 3/1971 Squibb
3,572,874 A 3/1971 Hassel
3,574,434 A 4/1971 Propst
3,575,465 A 4/1971 Dolby et al.
3,584,348 A 6/1971 Soltysik
3,584,417 A 6/1971 Gatton et al.
3,591,233 A 7/1971 Turcksin
3,596,297 A 8/1971 James
3,601,825 A 8/1971 Moorhead et al.
3,601,912 A 8/1971 Dubbs
3,605,650 A 9/1971 Hebel et al.
3,608,959 A 9/1971 Sarvas
3,612,289 A 10/1971 Zink
3,619,004 A 11/1971 McKernan et al.
3,620,376 A 11/1971 Gingher
3,626,647 A 12/1971 Guzelimian
3,635,174 A 1/1972 Ball et al.
3,636,661 A 1/1972 Strawsine
3,640,445 A 2/1972 Durham
3,643,608 A 2/1972 DeCesaris
3,654,382 A 4/1972 Rubright
3,655,065 A 4/1972 Yellin
3,655,253 A 4/1972 Deeds et al.
3,663,059 A 5/1972 Omlie
3,667,803 A 6/1972 Ford
3,674,068 A 7/1972 Lucci
3,680,942 A 8/1972 Davis
3,682,523 A 8/1972 Esposito
3,687,092 A 8/1972 Manning
3,688,707 A 9/1972 White
3,693,923 A 9/1972 Ayoub et al.
3,695,649 A 10/1972 Laverone
3,700,282 A 10/1972 Rowland
3,712,698 A 1/1973 Propst et al.
3,713,257 A 1/1973 Beavers
3,713,474 A 1/1973 Orlando
3,724,792 A 4/1973 Thalenfeld
3,730,601 A 5/1973 Misenheimer, III
3,736,035 A 5/1973 Brown et al.
3,736,602 A 6/1973 Miller
3,741,450 A 6/1973 Seastrom
3,741,852 A 6/1973 Keener
3,743,332 A 7/1973 Sonolet
3,745,936 A 7/1973 Bennett
3,748,006 A 7/1973 Levit et al.
3,749,299 A 7/1973 Ingle
3,756,116 A 9/1973 Schuplin
3,758,182 A 9/1973 Barecki et al.
3,761,971 A 10/1973 Behnke
3,774,966 A 11/1973 Faulkner et al.
3,778,175 A 12/1973 Zimmer
3,786,765 A 1/1974 Burr
3,786,932 A 1/1974 Smith
3,790,241 A 2/1974 Messina
3,797,790 A 3/1974 Iseki
3,806,220 A 4/1974 Payne
3,808,607 A 5/1974 Harder
3,810,430 A 5/1974 Siegal
3,811,728 A 5/1974 Redemske
D231,880 S 6/1974 Weinstock
3,814,034 A 6/1974 Seiz
3,827,377 A 8/1974 Aughtry, Jr.
3,830,168 A 8/1974 Crete
3,831,533 A 8/1974 Kellogg
3,835,795 A 9/1974 Levenberg
3,838,902 A 10/1974 Tenani
3,841,725 A 10/1974 Dorner
3,845,985 A 11/1974 Behrend et al.
3,848,388 A 11/1974 Bretche
3,851,936 A 12/1974 Muller
3,851,981 A 12/1974 Corsi
3,852,916 A 12/1974 Laby
3,857,622 A 12/1974 Mohr et al.
3,865,429 A 2/1975 Barker
3,871,153 A 3/1975 Birum, Jr.
3,871,726 A 3/1975 Stegner
D234,988 S 4/1975 Lopez-Benitez
3,875,711 A 4/1975 Palmer
3,877,764 A 4/1975 Hillier, Jr.
3,881,428 A 5/1975 Klecki
3,883,196 A 5/1975 Mohr
3,883,202 A 5/1975 Konig
3,890,495 A 6/1975 Bauer
3,892,189 A 7/1975 Killam
3,901,612 A 8/1975 Canin
3,910,659 A 10/1975 Peterson
3,913,498 A 10/1975 Hall
3,915,189 A 10/1975 Holbrook
3,916,972 A 11/1975 Breiner
3,922,045 A 11/1975 Meyer
3,927,481 A 12/1975 Safranek
3,944,283 A 3/1976 Molzon
3,945,742 A 3/1976 Condevaux
D239,424 S 4/1976 Offredi
3,964,401 A 6/1976 Gutmann, Jr. et al.
3,966,158 A 6/1976 Boundy
3,966,338 A 6/1976 Ghyczy
3,973,800 A 8/1976 Kogan
3,974,782 A 8/1976 Ruckriegel
3,974,917 A 8/1976 Waxmanski
3,978,554 A 9/1976 Miller, Jr.
3,984,884 A 10/1976 Spitz
3,990,741 A 11/1976 Snyder
4,009,796 A 3/1977 Schmidt
4,018,167 A 4/1977 Spangler
4,021,087 A 5/1977 Ferguson
4,022,136 A 5/1977 Schott

(56) References Cited

U.S. PATENT DOCUMENTS 4,026,508 A 5/1977 Ziegler
4,029,024 A 6/1977 Klitzky
4,030,748 A 6/1977 Brock
4,032,188 A 6/1977 Jones
4,034,864 A 7/1977 Tyson
4,037,614 A 7/1977 Hines
4,040,588 A 8/1977 Papsco
4,046,417 A 9/1977 Beckley
4,049,230 A 9/1977 Minniear
4,049,331 A 9/1977 Gutmann, Jr.
4,050,752 A 9/1977 Dykstra
D245,950 S 10/1977 Mathur
4,053,192 A 10/1977 Spetner
4,053,701 A 10/1977 Ogilvie et al.
4,055,373 A 10/1977 Andresen et al.
4,056,196 A 11/1977 Brauning
4,059,248 A 11/1977 Kuntz
4,062,589 A 12/1977 Klein
RE29,522 E 1/1978 Barecki
4,066,305 A 1/1978 Gazarek
4,069,927 A 1/1978 Taylor
4,070,013 A 1/1978 Sickler
4,070,075 A 1/1978 Morgan
D247,595 S 3/1978 Corson et al.
4,077,335 A 3/1978 Luzzani
4,090,335 A 5/1978 Curatolo
4,094,256 A 6/1978 Holper
4,094,561 A 6/1978 Wolff
4,106,736 A 8/1978 Becker, III
4,106,738 A 8/1978 Kostecky
4,108,086 A 8/1978 Yindra
4,109,328 A 8/1978 Mason
4,118,061 A 10/1978 Atkinson
4,118,084 A 10/1978 Sussman
4,118,903 A 10/1978 Coulthard
4,121,645 A 10/1978 Behr
4,125,787 A 11/1978 Ohhinata et al.
D250,922 S 1/1979 Adkinson
4,136,680 A 1/1979 Southworth
4,138,952 A 2/1979 Hodson
4,141,612 A 2/1979 Rowe
4,145,098 A 3/1979 Alexander
4,149,352 A 4/1979 Allen
4,156,515 A 5/1979 Mochly
4,158,936 A 6/1979 Fulton
D252,487 S 7/1979 Petersilie
4,161,254 A 7/1979 Taylor
4,162,113 A 7/1979 Pallavicini
4,163,572 A 8/1979 Benscoter
4,163,592 A 8/1979 Nelson
4,165,869 A 8/1979 Williams
4,165,902 A 8/1979 Ehrlich
4,166,195 A 8/1979 Schwab
4,185,430 A 1/1980 Gartung
4,186,533 A 2/1980 Jensen
4,186,666 A 2/1980 Honickman
4,188,066 A 2/1980 Terenzoni
4,192,562 A 3/1980 Bishoff
4,200,254 A 4/1980 Nelson
4,205,876 A 6/1980 Cetina
4,213,650 A 7/1980 Sroub
4,215,840 A 8/1980 Babberl
4,219,101 A 8/1980 Valsvik
D256,829 S 9/1980 Qui et al.
4,222,541 A 9/1980 Cillis
4,224,769 A 9/1980 Ball
4,227,758 A 10/1980 Clare
4,230,365 A 10/1980 Messinger
D257,603 S 12/1980 Cyplik
4,236,460 A 12/1980 Poupko
4,243,279 A 1/1981 Ackeret
4,258,856 A 3/1981 Marling
4,263,683 A 4/1981 Knoke
4,266,714 A 5/1981 Crane
4,272,136 A 6/1981 Sengua
4,281,602 A 8/1981 Lange
D260,826 S 9/1981 Steinberger
4,287,837 A 9/1981 Bayles
4,290,657 A 9/1981 Haas
4,291,999 A 9/1981 Vandelanoite
4,295,697 A 10/1981 Grime
4,296,981 A 10/1981 Hildebrandt
4,297,952 A 11/1981 Zagaroli
4,298,291 A 11/1981 Ward, Jr.
4,311,101 A 1/1982 de Almagro
4,311,337 A 1/1982 Brunn
4,312,086 A 1/1982 Bianco
4,314,280 A 2/1982 Rose
4,318,353 A 3/1982 Schier
4,320,935 A 3/1982 Nagelkirk
D263,770 S 4/1982 Melchior
4,323,291 A 4/1982 Ball
4,324,076 A 4/1982 Honickman
4,325,597 A 4/1982 Morrison
4,334,483 A 6/1982 Kellogg
4,352,432 A 10/1982 Smith
4,353,661 A 10/1982 Ruther
4,372,629 A 2/1983 Propst
4,382,642 A 5/1983 Burdick
4,385,850 A 5/1983 Bobath
D269,237 S 6/1983 Burdick
4,387,872 A 6/1983 Hogue
4,387,873 A 6/1983 Pavlo
4,393,915 A 7/1983 Olson
4,401,222 A 8/1983 Kulikowski
4,403,677 A 9/1983 Messinger
4,407,476 A 10/1983 Bohannan
4,418,967 A 12/1983 Winkelman, Jr. et al.
4,422,385 A 12/1983 Rutsche
4,423,913 A 1/1984 Lee
4,429,850 A 2/1984 Weber
4,429,934 A 2/1984 VandenHoek
4,437,278 A 3/1984 Thomas, Jr.
4,437,714 A 3/1984 Struck
4,450,775 A 5/1984 Brendle
4,455,102 A 6/1984 Baroi et al.
4,457,436 A 7/1984 Kelley
4,458,961 A 7/1984 Browning
4,463,057 A 7/1984 Knurr
4,471,586 A 9/1984 Shuch
4,472,009 A 9/1984 Bell
4,477,128 A 10/1984 Hasbrouck
RE31,733 E 11/1984 Haworth et al.
4,482,195 A 11/1984 Chapin
4,490,064 A 12/1984 Ducharme
4,508,231 A 4/1985 Honickman
4,516,341 A 5/1985 Jenkins
4,516,509 A 5/1985 Langenegger
4,516,619 A 5/1985 Hasbrouck
4,516,620 A 5/1985 Mulhern
4,522,130 A 6/1985 Worthington
4,525,093 A 6/1985 Moll
4,526,250 A 7/1985 Messinger
4,535,577 A 8/1985 Tenser et al.
4,535,703 A 8/1985 Henriott
4,545,142 A 10/1985 Whisnant
4,559,738 A 12/1985 Helfman
4,561,229 A 12/1985 Gartung
4,570,408 A 2/1986 Frascaroli
4,572,694 A 2/1986 Hoeksema
4,580,854 A 4/1986 Hedfeld
4,582,002 A 4/1986 Wright
D283,855 S 5/1986 Kujawski
D283,872 S 5/1986 Clendinen
4,586,759 A 5/1986 Wrobel
4,588,227 A 5/1986 Austin
4,590,865 A 5/1986 Rutsche
4,591,289 A 5/1986 Vickers
4,601,247 A 7/1986 Welch
4,602,817 A 7/1986 Raftery
4,603,787 A 8/1986 Essary
4,610,560 A 9/1986 Miller
4,618,192 A 10/1986 Kelley
4,619,486 A 10/1986 Hannah

(56) References Cited

U.S. PATENT DOCUMENTS 4,620,489 A 11/1986 Albano
4,621,381 A 11/1986 Schramek
4,621,865 A 11/1986 Herrera
4,623,088 A 11/1986 Holden
4,624,083 A 11/1986 Diffrient
4,625,483 A 12/1986 Zacky
4,632,040 A 12/1986 Sheffer
4,632,459 A 12/1986 Herschlag
4,633,789 A 1/1987 Kortering
4,637,666 A 1/1987 Worrell
4,639,049 A 1/1987 Frascaroli
4,645,161 A 2/1987 Collins
D288,748 S 3/1987 Klein
4,646,655 A * 3/1987 Robolin ..... A47B 21/00
108/101
4,653,652 A 3/1987 Avati
4,653,662 A 3/1987 Wise et al.
4,653,713 A 3/1987 Hamilton
4,654,756 A 3/1987 Wilson
4,662,092 A 5/1987 Kim
4,666,115 A 5/1987 Schiro
4,678,151 A 7/1987 Radek
4,679,510 A 7/1987 Veyhl
4,684,094 A 8/1987 Everett
4,685,647 A 8/1987 Calhoun
4,688,491 A 8/1987 Herrera et al.
4,688,869 A 8/1987 Kelly
4,698,936 A 10/1987 Helfman
4,699,067 A 10/1987 Okopny
4,700,993 A 10/1987 Fu Long
4,708,132 A 11/1987 Silvestrini
4,712,942 A 12/1987 Brown
4,713,949 A 12/1987 Wilcox
4,714,027 A 12/1987 Stern
4,714,373 A 12/1987 Heekin
4,717,358 A 1/1988 Chaundy
4,718,132 A 1/1988 Wirland
4,725,030 A 2/1988 Miller
4,730,802 A 3/1988 Chatham
4,732,088 A 3/1988 Koechlin
4,732,089 A 3/1988 Mueller
4,734,826 A 3/1988 Wilson
4,735,152 A 4/1988 Bricker
4,735,467 A 4/1988 Wolters
D295,810 S 5/1988 Saporiti
4,744,492 A 5/1988 Hackmann et al.
4,747,248 A 5/1988 Fahs
4,748,913 A 6/1988 Favaretto
4,750,432 A 6/1988 McNamara
4,761,931 A 8/1988 Schrunk
4,762,072 A 8/1988 Boundy
4,763,581 A 8/1988 Weese
4,765,253 A 8/1988 Schappach
4,766,422 A 8/1988 Wolters
4,771,583 A 9/1988 Ball
4,773,337 A 9/1988 Ball
4,774,792 A 10/1988 Balance
4,778,487 A 10/1988 Chenel
4,779,940 A 10/1988 Ralston
4,781,127 A 11/1988 Conley
4,782,637 A 11/1988 Eriksson et al.
4,784,468 A 11/1988 Tierney
4,785,742 A 11/1988 Esslinger
4,786,119 A 11/1988 Smuda
4,792,881 A 12/1988 Wilson et al.
4,795,355 A 1/1989 Dorn
4,798,423 A 1/1989 LaCour
4,799,432 A 1/1989 Rickner
4,805,784 A 2/1989 Solheim
4,807,838 A 2/1989 Anderson
4,819,986 A 4/1989 Markus
4,821,477 A 4/1989 Rydqvist
4,827,849 A 5/1989 Vignale
4,831,791 A 5/1989 Ball
4,832,241 A 5/1989 Radcliffe
4,832,421 A 5/1989 Shoffner
4,834,450 A 5/1989 Stickler
4,838,175 A 6/1989 Hauville
4,838,177 A 6/1989 Vander Park
4,840,584 A 6/1989 Cox
4,846,430 A 7/1989 Ke
4,850,285 A 7/1989 Suttles
4,852,500 A 8/1989 Ryburg
4,856,242 A 8/1989 Baloga
D303,327 S 9/1989 Masarotti
4,869,378 A 9/1989 Miller
4,875,418 A 10/1989 Moeckl
4,879,955 A 11/1989 Moll
4,882,885 A 11/1989 Chatterson et al.
4,884,513 A 12/1989 Newhouse
4,884,702 A 12/1989 Rekow
4,891,922 A 1/1990 Hozer
4,905,428 A 3/1990 Sykes
4,914,873 A 4/1990 Newhouse
4,915,034 A 4/1990 Grabe
4,915,120 A 4/1990 Ziolkowski
4,224,769 B1 5/1990 Ball
4,925,143 A 5/1990 Sandmeyer
4,934,765 A 6/1990 Slifer, Sr.
4,938,442 A 7/1990 Mastrodicasa
4,941,717 A 7/1990 Beaulieu
4,944,235 A 7/1990 Jahnke
4,945,584 A 8/1990 LaMantia
4,947,601 A 8/1990 McGuire
4,948,205 A 8/1990 Kelley
4,953,696 A 9/1990 Huang
4,957,262 A 9/1990 Kemper
4,957,333 A 9/1990 Hsu
4,966,181 A 10/1990 Liberman et al.
4,971,281 A 11/1990 Steinbeck
4,974,913 A 12/1990 Vogt
4,977,696 A 12/1990 Johansson
4,985,195 A 1/1991 Wilson
4,986,194 A 1/1991 Bollman
4,986,198 A 1/1991 Naito
4,986,330 A 1/1991 McGonagle
4,998,636 A 3/1991 Hardigg
5,004,192 A 4/1991 Handler
5,008,966 A 4/1991 Lepow
5,016,765 A 5/1991 Leonardo
5,018,323 A 5/1991 Clausen
5,022,621 A 6/1991 Quest
5,024,167 A 6/1991 Hayward
5,025,603 A 6/1991 Johnson
5,026,614 A 6/1991 Itoh
5,031,683 A 7/1991 Marvy
5,033,624 A 7/1991 DeGelder
5,035,389 A 7/1991 Wang
D318,966 S 8/1991 Schroff et al.
5,038,539 A 8/1991 Kelley
5,040,681 A 8/1991 Grusin
5,041,002 A 8/1991 Byrne
5,041,770 A 8/1991 Seiler
5,048,698 A 9/1991 Konrad
5,050,267 A 9/1991 Quest
5,056,746 A 10/1991 Parsons
D321,435 S 11/1991 Scalisi et al.
5,069,263 A 12/1991 Edwards
5,069,506 A 12/1991 Wieland
5,070,666 A 12/1991 Looman
5,071,204 A 12/1991 Price
5,074,422 A 12/1991 Holtz
5,078,055 A 1/1992 Bellini
5,080,238 A 1/1992 Hochman
5,080,438 A 1/1992 Moyer
5,082,120 A 1/1992 Vega
5,083,512 A 1/1992 Newhouse
5,085,153 A 2/1992 McKee
5,086,195 A 2/1992 Claisse
5,086,606 A 2/1992 Finses
5,086,958 A 2/1992 Nagy
5,092,253 A 3/1992 Grund et al.
5,094,174 A 3/1992 Grund
5,094,516 A 3/1992 Hunter

(56) References Cited

U.S. PATENT DOCUMENTS 5,101,989 A 4/1992 Jones
5,103,741 A 4/1992 Grund
5,104,080 A 4/1992 Berger
5,109,992 A 5/1992 Miller
5,121,974 A 6/1992 Monson
5,123,549 A 6/1992 Finses
5,125,518 A 6/1992 Ward
5,129,202 A 7/1992 Payne
5,130,494 A 7/1992 Simonton
5,131,620 A 7/1992 Boundy
5,134,826 A 8/1992 La Roche
D329,875 S 9/1992 Stern et al.
5,144,888 A 9/1992 Heine
5,144,896 A 9/1992 Fortsch
5,148,646 A 9/1992 Lutostanski
5,154,126 A 10/1992 Newhouse
5,155,955 A 10/1992 Ball
5,158,472 A 10/1992 Juhlin
5,165,614 A 11/1992 Fourche
5,167,047 A 12/1992 Plumley
5,168,889 A 12/1992 Diestel
5,172,641 A 12/1992 Auer
5,173,001 A 12/1992 Schunke
5,174,225 A 12/1992 Reise
5,174,532 A 12/1992 Huang
5,177,899 A 1/1993 Powell
5,177,912 A 1/1993 Ball
5,183,319 A 2/1993 Pearson
5,184,441 A 2/1993 Balfanz, Jr.
5,185,972 A 2/1993 Markiewicz
5,186,425 A 2/1993 Keusch
5,187,641 A 2/1993 Muskatello
5,197,614 A 3/1993 Dalton
5,203,135 A 4/1993 Bastian
5,206,972 A 5/1993 Nudelmont
5,208,731 A 5/1993 Blomquist
D336,185 S 6/1993 Deinen et al.
5,214,890 A 6/1993 Levitan et al.
5,215,108 A 6/1993 Sprague
5,217,124 A 6/1993 Stone
5,220,871 A 6/1993 Grund
D337,219 S 7/1993 Dokoupil et al.
D337,450 S 7/1993 Dettinger
5,224,610 A 7/1993 Veazey
5,226,179 A 7/1993 Choi
5,228,579 A 7/1993 Kaufman
5,230,492 A 7/1993 Zwart
5,230,552 A 7/1993 Schipper et al.
5,231,562 A 7/1993 Pierce
D337,911 S 8/1993 Gibson
5,233,707 A 8/1993 Perkins
5,237,935 A 8/1993 Newhouse
5,241,717 A 9/1993 Ward
5,241,796 A 9/1993 Hellwig
5,241,914 A 9/1993 Korb
5,242,048 A 9/1993 Ellingsworth
5,252,086 A 10/1993 Russell
5,255,478 A 10/1993 Baranowski
5,255,966 A 10/1993 Newhouse et al.
5,257,701 A 11/1993 Edelson
5,261,736 A 11/1993 Sisbarro
5,263,772 A 11/1993 Ritzow
5,265,972 A 11/1993 Bahr
5,267,715 A 12/1993 Owen
5,272,988 A 12/1993 Kelley
D342,837 S 1/1994 Forcolini
5,277,005 A 1/1994 Hellwig et al.
5,277,007 A 1/1994 Hellwig
5,277,132 A 1/1994 Korb
5,277,512 A 1/1994 Dwillies
5,285,900 A 2/1994 Swingler
5,287,666 A 2/1994 Frascaroli
5,287,909 A 2/1994 King et al.
5,295,594 A 3/1994 Melzian
5,297,486 A 3/1994 Herrmann
5,305,883 A 4/1994 Gage
5,308,031 A 5/1994 Evenson
D347,622 S 6/1994 Flasz
5,317,977 A 6/1994 Omessi
5,321,579 A 6/1994 Brown
5,322,022 A 6/1994 Burkholder
D348,432 S 7/1994 Dubruco
5,327,838 A 7/1994 Beltman
5,328,260 A 7/1994 Beirise
5,333,744 A 8/1994 LoCicero
5,339,576 A 8/1994 Fussler
5,339,747 A 8/1994 Epps
5,340,326 A 8/1994 LeMaster
5,341,615 A 8/1994 Hodges
5,341,749 A 8/1994 Noakes
5,346,296 A 9/1994 Kelley
5,347,778 A 9/1994 Bray
5,349,135 A 9/1994 Mollenkopf et al.
5,353,566 A 10/1994 Boon et al.
5,354,025 A 10/1994 McCaffrey
5,354,027 A 10/1994 Cox
5,357,874 A 10/1994 Palmer
5,359,826 A 11/1994 Grearson
5,360,121 A 11/1994 Sothman
5,362,923 A 11/1994 Newhouse
5,378,077 A 1/1995 Paulsen
5,380,034 A 1/1995 Wilson
5,381,908 A 1/1995 Hepp
5,386,787 A 2/1995 Hall
5,392,934 A 2/1995 Fox
5,394,658 A 3/1995 Schreiner et al.
5,394,809 A 3/1995 Feldpausch
5,398,622 A 3/1995 Lubinskas et al.
5,400,719 A 3/1995 Santapa
5,402,988 A 4/1995 Eisele
5,403,082 A 4/1995 Kramer
5,406,894 A 4/1995 Herrmann
5,415,454 A 5/1995 Fu Tsung
5,415,461 A 5/1995 Sakamoto
D359,161 S 6/1995 Byrne
D359,631 S 6/1995 Bubb
5,423,151 A 6/1995 Caro et al.
D360,310 S 7/1995 Stamberg et al.
5,428,928 A 7/1995 Hellwig
5,429,431 A 7/1995 Olson
5,433,152 A 7/1995 Henry
5,437,235 A 8/1995 Randolph
5,437,426 A 8/1995 MacDonald
5,438,937 A 8/1995 Ball
5,441,151 A 8/1995 Billingham
5,441,338 A 8/1995 Kane
5,443,017 A * 8/1995 Wacker ..... A47B 9/04
108/147
5,451,101 A 9/1995 Ellison
5,454,638 A 10/1995 Bird
5,466,058 A 11/1995 Chan
5,467,703 A 11/1995 Crinion
5,469,794 A 11/1995 Laderoute
5,472,164 A 12/1995 Contee, Jr.
5,473,994 A 12/1995 Foley
5,479,733 A 1/1996 Kusina
5,483,904 A 1/1996 Kelly
5,486,042 A 1/1996 Heisler
D366,978 S 2/1996 Mariol
D367,364 S 2/1996 Lewis
5,490,357 A 2/1996 Lin
D368,177 S 3/1996 Mourgue
D368,314 S 3/1996 Lin
5,499,868 A 3/1996 Schainholz
5,511,348 A 4/1996 Cornell
5,516,298 A 5/1996 Smith
5,522,324 A 6/1996 van Gelder
D371,703 S 7/1996 Muller-Deisig et al.
5,535,972 A 7/1996 Fallago
5,537,290 A 7/1996 Brown
5,542,553 A 8/1996 Penniman
5,544,593 A 8/1996 Canfield
5,546,873 A 8/1996 Conner
5,547,080 A 8/1996 Klimas

(56) References Cited

U.S. PATENT DOCUMENTS 5,549,055 A 8/1996 Kusch
5,553,551 A 9/1996 Crombie
5,555,694 A 9/1996 Commins
5,556,067 A 9/1996 Konig
5,556,181 A 9/1996 Bertrand
5,560,302 A 10/1996 Diffrient
5,560,303 A 10/1996 Severin
5,564,784 A 10/1996 Felling
5,568,773 A 10/1996 Hung
D375,845 S 11/1996 Mourgue
5,572,751 A 11/1996 Brandt
5,573,320 A 11/1996 Shearer
5,586,593 A 12/1996 Schwartz
5,588,376 A 12/1996 Seidl
5,592,884 A 1/1997 Glick
5,595,494 A 1/1997 Wiebe
D378,028 S 2/1997 Schefcik
5,598,678 A 2/1997 Reynolds
5,603,405 A 2/1997 Smith
5,606,920 A 3/1997 Meyer
5,609,112 A 3/1997 Meyer
5,609,402 A 3/1997 Kemp
5,611,608 A 3/1997 Clausen
5,615,783 A 4/1997 Warnken
5,621,994 A 4/1997 Cobb et al.
5,622,197 A 4/1997 Valaire
5,623,880 A 4/1997 Kuntz
5,623,882 A 4/1997 Price
5,628,257 A 5/1997 Conner
5,628,759 A 5/1997 McCool
D379,987 S 6/1997 Scheid et al.
D380,095 S 6/1997 Diaz-Azcuy
5,634,300 A 6/1997 Huebner
5,638,759 A 6/1997 Klugkist
D381,216 S 7/1997 Paus
5,642,557 A 7/1997 Clews
5,644,995 A 7/1997 Gurwell
5,649,742 A 7/1997 Liu
D382,123 S 8/1997 Pimental et al.
D382,736 S 8/1997 Kopish
5,658,635 A 8/1997 Davis et al.
5,662,132 A 9/1997 Larsen
5,662,298 A 9/1997 Collins
5,666,713 A 9/1997 Kubota
5,669,498 A 9/1997 Fierek
5,673,632 A 10/1997 Sykes
5,678,491 A 10/1997 Price
5,678,792 A 10/1997 Arguin et al.
5,678,907 A 10/1997 Schainholz
5,680,820 A 10/1997 Randolph
5,683,154 A 11/1997 Chang
5,683,198 A 11/1997 Leutenegger
D387,583 S 12/1997 Shear
5,697,686 A 12/1997 Miller
5,698,759 A 12/1997 Fray
5,704,683 A 1/1998 Cooper
5,709,156 A 1/1998 Gevaert
5,711,121 A 1/1998 Garver
5,715,760 A 2/1998 Frascaroli et al.
5,715,761 A 2/1998 Frattini
5,718,179 A 2/1998 Johnson
5,718,492 A 2/1998 Ellison
5,720,547 A 2/1998 Baird
D392,470 S 3/1998 Smith
D392,775 S 3/1998 McMahon
5,724,778 A 3/1998 Cornell
5,730,414 A 3/1998 Wenger et al.
5,738,422 A 4/1998 Welborn, Jr. et al.
5,738,462 A 4/1998 Petersen
5,740,650 A 4/1998 Seiber et al.
5,740,743 A 4/1998 Schairbaum
5,746,488 A 5/1998 LaCour
5,752,449 A 5/1998 Simon
5,752,450 A 5/1998 Roesner
5,754,995 A 5/1998 Behrendt
5,755,321 A 5/1998 Wang
5,756,539 A 5/1998 Skrumsager
5,765,932 A 6/1998 Domina et al.
5,771,954 A 6/1998 Benner
5,775,778 A 7/1998 Riley
5,778,804 A 7/1998 Read
5,791,259 A 8/1998 Mansfield
5,791,265 A 8/1998 Ellsworth et al.
5,791,751 A 8/1998 Meyer et al.
5,794,545 A 8/1998 McDaniel
5,794,902 A 8/1998 Henry
5,795,028 A 8/1998 Dussia, Jr.
5,799,430 A 9/1998 Fremstad
5,802,672 A 9/1998 Rohder
5,802,778 A 9/1998 Thorp
5,802,789 A 9/1998 Goodman
5,803,561 A 9/1998 Puehlhorn
5,806,258 A 9/1998 Miedema
5,809,708 A 9/1998 Greer
D399,661 S 10/1998 Smith
5,816,001 A 10/1998 Goodman
5,823,624 A 10/1998 Dahlbacka
5,826,955 A 10/1998 Sanders
5,831,211 A 11/1998 Gartung
5,833,065 A 11/1998 Burgess
5,833,332 A 11/1998 Marshall
5,836,112 A 11/1998 Lindale
5,839,240 A 11/1998 Elsholz
5,839,462 A 11/1998 Randall
5,853,236 A 12/1998 Rogers et al.
5,857,415 A 1/1999 Richard
5,860,713 A 1/1999 Richardson
D405,976 S 2/1999 Beall
D405,979 S 2/1999 Kramer et al.
5,865,409 A 2/1999 Nimer
5,867,955 A 2/1999 Russell
5,870,868 A 2/1999 Kita et al.
5,876,002 A 3/1999 White
5,881,500 A 3/1999 Latino
5,886,295 A 3/1999 Carino
5,890,325 A 4/1999 Corcorran
5,890,614 A 4/1999 Dancyger
5,890,782 A 4/1999 Alberts
5,893,606 A 4/1999 Chiang
5,894,614 A 4/1999 Stroud
5,896,817 A 4/1999 Hancock
5,896,995 A 4/1999 Murray
5,897,178 A 4/1999 Ohara
5,901,513 A 5/1999 Mollenkopf
5,904,104 A 5/1999 Yu
5,906,035 A 5/1999 Atkins
5,906,420 A 5/1999 Rozier, Jr.
D410,800 S 6/1999 Gomez
5,908,002 A 6/1999 Alexander
5,911,178 A 6/1999 Alexander
5,921,042 A 7/1999 Ashton
5,921,052 A 7/1999 Kemp
5,921,411 A 7/1999 Merl
5,927,311 A 7/1999 Jager
D413,306 S 8/1999 Scherer et al.
5,934,201 A 8/1999 Diffrient
5,934,203 A 8/1999 Glass
5,934,679 A 8/1999 Strain et al.
5,937,924 A 8/1999 Cooper
5,941,397 A 8/1999 Buchanan
5,943,834 A 8/1999 Jeffers
5,943,966 A 8/1999 Machado
5,947,307 A 9/1999 Battaglia
5,947,742 A 9/1999 Katayama
5,950,371 A 9/1999 Rives
5,950,649 A 9/1999 Gerig
5,954,409 A 9/1999 LaCour
5,957,556 A 9/1999 Singer
5,967,631 A 10/1999 Ko
5,970,662 A 10/1999 Corcorran
5,971,508 A 10/1999 Deimen
5,971,509 A 10/1999 Deimen
D415,901 S 11/1999 Arko et al.
5,974,985 A 11/1999 Flototto

(56) References Cited

U.S. PATENT DOCUMENTS

| | | | |
|---|---|---|---|
| 5,975,657 | A | 11/1999 | LaCour |
| 5,976,663 | A | 11/1999 | Davis |
| 5,979,988 | A | 11/1999 | Heidmann |
| 5,983,420 | A | 11/1999 | Tilley |
| 5,986,212 | A | 11/1999 | Lhota |
| 5,988,076 | A | 11/1999 | Vander Park |
| 5,988,383 | A | 11/1999 | Armstrong |
| 5,988,755 | A | 11/1999 | Fastelli |
| 5,993,216 | A | 11/1999 | Stogner |
| 5,994,644 | A | 11/1999 | Rindoks |
| 5,996,145 | A | 12/1999 | Taylor |
| 6,000,179 | A | 12/1999 | Musculus |
| 6,000,343 | A | 12/1999 | Laney |
| 6,000,750 | A | 12/1999 | Rossman |
| 6,003,446 | A | 12/1999 | Leibowitz |
| 6,003,447 | A | 12/1999 | Cox |
| 6,004,065 | A | 12/1999 | Higdon |
| D418,611 | S | 1/2000 | Montague, III |
| 6,012,690 | A | 1/2000 | Cohen |
| 6,015,124 | A | 1/2000 | Loy |
| 6,024,024 | A | 2/2000 | Favaretto |
| 6,024,599 | A | 2/2000 | Stathis |
| 6,029,580 | A | 2/2000 | Alfonso |
| 6,036,150 | A | 3/2000 | Lehrman |
| 6,036,516 | A | 3/2000 | Byrne |
| 6,037,538 | A | 3/2000 | Brooks |
| 6,039,420 | A | 3/2000 | Besserer et al. |
| 6,041,722 | A | 3/2000 | Baker |
| 6,047,508 | A | 4/2000 | Goodman et al. |
| 6,050,426 | A | 4/2000 | Leurdijk |
| 6,050,646 | A | 4/2000 | Stenzel et al. |
| 6,050,659 | A | 4/2000 | LaCour |
| D423,808 | S | 5/2000 | Natuzzi et al. |
| 6,055,912 | A | 5/2000 | Doud |
| 6,059,109 | A | 5/2000 | Stein |
| 6,061,972 | A | 5/2000 | Thorp |
| 6,070,956 | A | 6/2000 | Yates |
| 6,076,308 | A | 6/2000 | Lyon |
| 6,076,317 | A | 6/2000 | Hellwig |
| 6,076,474 | A | 6/2000 | Grabowski |
| 6,076,903 | A | 6/2000 | Vander Park |
| 6,079,803 | A | 6/2000 | West |
| D427,783 | S | 7/2000 | Luedke |
| 6,082,838 | A | 7/2000 | Bissu Palombo |
| 6,082,840 | A | 7/2000 | Chau |
| 6,086,028 | A | 7/2000 | Pfister |
| D429,081 | S | 8/2000 | Gomez |
| 6,098,349 | A | 8/2000 | Zheng |
| 6,098,821 | A | 8/2000 | Dube |
| 6,107,576 | A | 8/2000 | Morton |
| 6,109,280 | A | 8/2000 | Custer |
| D430,543 | S | 9/2000 | Rohder |
| 6,119,317 | A | 9/2000 | Pfister |
| 6,119,878 | A | 9/2000 | Zen |
| 6,119,989 | A | 9/2000 | Hollington |
| 6,120,097 | A | 9/2000 | Perry et al. |
| 6,120,207 | A | 9/2000 | Goto |
| D432,807 | S | 10/2000 | Gollinucci |
| 6,125,600 | A | 10/2000 | Bastian |
| 6,132,666 | A | 10/2000 | Foley et al. |
| 6,133,528 | A | 10/2000 | Henriott et al. |
| 6,134,852 | A | 10/2000 | Shipman et al. |
| 6,135,545 | A | 10/2000 | Liao |
| 6,135,583 | A | 10/2000 | Simon |
| 6,138,827 | A | 10/2000 | Marshall |
| 6,138,831 | A | 10/2000 | Agostinelli |
| 6,138,841 | A | 10/2000 | Klein |
| 5,802,789 | B1 | 11/2000 | Goodman |
| 6,146,047 | A | 11/2000 | Saito |
| 6,148,958 | A | 11/2000 | Ahl et al. |
| 6,152,047 | A | 11/2000 | Mac Namara |
| 6,152,048 | A | 11/2000 | Vander Park |
| 6,152,312 | A | 11/2000 | Nava |
| 6,158,178 | A | 12/2000 | Jeffers et al. |
| 6,161,486 | A | 12/2000 | Boots |
| 6,164,467 | A | 12/2000 | DePottey |
| 6,167,579 | B1 | 1/2001 | Kopish |
| 6,167,676 | B1 | 1/2001 | Shipman |
| 6,170,200 | B1 | 1/2001 | Cornell |
| 6,170,410 | B1 | 1/2001 | Gioacchini |
| 6,176,561 | B1 | 1/2001 | Roels |
| 6,180,884 | B1 | 1/2001 | Tokunaga |
| 6,182,579 | B1 | 2/2001 | Chang |
| 6,182,580 | B1 | 2/2001 | Barrett |
| 6,183,280 | B1 | 2/2001 | Laukhuf |
| 6,189,268 | B1 | 2/2001 | Carr |
| D438,402 | S | 3/2001 | Walsh |
| D439,624 | S | 3/2001 | Webb |
| 6,196,648 | B1 | 3/2001 | Henriott |
| 6,199,321 | B1 | 3/2001 | Ginzel |
| 6,202,567 | B1 | 3/2001 | Funk |
| 6,205,716 | B1 | 3/2001 | Peltz |
| 6,206,206 | B1 | 3/2001 | Saylor |
| D440,448 | S | 4/2001 | Horsten |
| 6,213,191 | B1 | 4/2001 | Nitzsche |
| 6,213,919 | B1 | 4/2001 | Wang |
| 6,216,397 | B1 | 4/2001 | Chang |
| 6,216,606 | B1 | 4/2001 | Kathardekar et al. |
| 6,220,186 | B1 | 4/2001 | Scharer |
| 6,224,029 | B1 | 5/2001 | Marble |
| 6,233,900 | B1 | 5/2001 | Gill |
| 6,234,385 | B1 | 5/2001 | Espinoza |
| D443,157 | S | 6/2001 | Linder |
| 6,240,587 | B1 | 6/2001 | Meichtry et al. |
| 6,240,687 | B1 | 6/2001 | Chong |
| 6,241,317 | B1 | 6/2001 | Wu |
| 6,250,020 | B1 | 6/2001 | Shipman |
| 6,253,509 | B1 | 7/2001 | Hellwig et al. |
| 6,254,206 | B1 | 7/2001 | Petrick |
| 6,254,427 | B1 | 7/2001 | Stathis |
| 6,267,064 | B1 | 7/2001 | Ostertag |
| 6,267,338 | B1 | 7/2001 | Saylor |
| D446,039 | S | 8/2001 | Gomez |
| 6,270,162 | B1 | 8/2001 | Jeny |
| 6,276,382 | B1 | 8/2001 | Bindschatel et al. |
| 6,282,854 | B1 | 9/2001 | Vos |
| 6,283,043 | B1 | 9/2001 | Stern |
| 6,283,564 | B1 | 9/2001 | Corson |
| 6,285,544 | B1 | 9/2001 | Chandramohan |
| 6,286,192 | B2 | 9/2001 | Pfister |
| 6,289,826 | B1 | 9/2001 | Waisbrod |
| 6,293,506 | B1 | 9/2001 | Gutgsell |
| D448,946 | S | 10/2001 | Goetz |
| 6,296,002 | B1 | 10/2001 | Tashchyan |
| 6,302,035 | B1 | 10/2001 | Frenkler |
| 6,302,053 | B1 | 10/2001 | Tomczak et al. |
| 6,302,366 | B1 | 10/2001 | Saylor |
| 6,308,641 | B1 | 10/2001 | Kingbury |
| D450,959 | S | 11/2001 | Birsel et al. |
| 6,318,276 | B1 | 11/2001 | Reinecke |
| 6,324,997 | B1 | 12/2001 | Baker |
| 6,327,983 | B1 | 12/2001 | Cronk |
| 6,329,960 | B1 | 12/2001 | Andrew |
| 6,330,773 | B1 | 12/2001 | MacDonald |
| 6,336,414 | B1 | 1/2002 | Stewart |
| 6,338,172 | B1 | 1/2002 | Taylor |
| 6,338,226 | B1 | 1/2002 | Gauthier |
| 6,340,145 | B1 | 1/2002 | Tagami |
| 6,341,666 | B1 | 1/2002 | Allen |
| 6,341,822 | B2 | 1/2002 | Apissomian |
| 6,347,591 | B1 | 2/2002 | Karpa |
| 6,347,592 | B1 | 2/2002 | Gessert |
| 6,349,507 | B1 | 2/2002 | Muellerleile |
| 6,354,043 | B1 | 3/2002 | Simon |
| 6,357,616 | B1 | 3/2002 | Harris |
| 6,362,420 | B1 | 3/2002 | Bacouelle et al. |
| 6,363,414 | B1 | 3/2002 | Nicholls |
| D455,302 | S | 4/2002 | Minami |
| D456,293 | S | 4/2002 | Tsumura et al. |
| 6,364,128 | B1 | 4/2002 | Wohlford |
| 6,367,874 | B2 | 4/2002 | Casini |
| 6,367,880 | B1 | 4/2002 | Niederman |
| 6,370,741 | B1 | 4/2002 | Lu |
| 6,371,309 | B1 | 4/2002 | Smith |

(56) References Cited

U.S. PATENT DOCUMENTS

| | | | |
|---|---|---|---|
| 6,372,560 | B1 | 4/2002 | Jen |
| 6,374,455 | B1 | 4/2002 | Regele et al. |
| 6,374,548 | B1 | 4/2002 | Ruedinger et al. |
| D457,017 | S | 5/2002 | Muller |
| D457,359 | S | 5/2002 | Chan |
| D457,736 | S | 5/2002 | Simons, Jr. et al. |
| D457,737 | S | 5/2002 | Citterio |
| 6,382,747 | B1 | 5/2002 | Catta |
| 6,384,329 | B2 | 5/2002 | Buard |
| 6,393,658 | B1 | 5/2002 | Chong |
| 6,394,001 | B1 | 5/2002 | Giesey |
| D458,040 | S | 6/2002 | Stannis et al. |
| D458,041 | S | 6/2002 | Couture et al. |
| D458,463 | S | 6/2002 | Citterio |
| 6,397,762 | B1 | 6/2002 | Goldberg |
| 6,398,326 | B1 | 6/2002 | Wang |
| 6,401,862 | B1 | 6/2002 | Caron |
| 6,402,111 | B1 | 6/2002 | Stewart |
| 6,402,233 | B1 | 6/2002 | Tseng |
| 6,410,855 | B1 | 6/2002 | Berkowitz |
| 6,422,398 | B2 | 7/2002 | LaFontaine |
| 6,425,219 | B1 | 7/2002 | Barmak |
| 6,427,608 | B1 | 8/2002 | Crinion |
| 6,427,609 | B1 | 8/2002 | Grant |
| 6,430,049 | B1 | 8/2002 | Lai et al. |
| 6,431,436 | B1 | 8/2002 | Evers |
| 6,435,106 | B2 | 8/2002 | Funk |
| 6,435,461 | B1 | 8/2002 | Saylor |
| 6,442,909 | B2 | 9/2002 | Waalkes et al. |
| 6,446,981 | B1 | 9/2002 | Wise |
| 6,447,067 | B1 | 9/2002 | Williams et al. |
| 6,447,080 | B1 | 9/2002 | Rheault |
| 6,454,358 | B1 | 9/2002 | Benincasa |
| 6,457,422 | B1 | 10/2002 | Saul |
| 6,463,701 | B1 | 10/2002 | Baloga |
| 6,469,747 | B1 | 10/2002 | Rai |
| D465,201 | S | 11/2002 | Gershfeld |
| 6,474,025 | B1 | 11/2002 | Faiks |
| 6,480,243 | B2 | 11/2002 | Yamamoto |
| 6,481,163 | B1 | 11/2002 | King et al. |
| 6,481,177 | B1 | 11/2002 | Wood |
| 6,481,678 | B1 | 11/2002 | Chong |
| 6,483,027 | B1 | 11/2002 | Howard |
| 6,484,360 | B1 | 11/2002 | DeBartolo, Jr. |
| D467,092 | S | 12/2002 | Vu |
| 6,488,347 | B1 | 12/2002 | Bienick |
| 6,490,829 | B1 | 12/2002 | Schreiner |
| 6,490,981 | B2 | 12/2002 | Isensee |
| 6,494,335 | B1 | 12/2002 | Kellogg et al. |
| 6,497,184 | B1 | 12/2002 | Whitesitt |
| 6,497,268 | B1 | 12/2002 | Peppett |
| 6,499,608 | B1 | 12/2002 | Sterling |
| D468,837 | S | 1/2003 | Shilling et al. |
| 6,510,663 | B2 | 1/2003 | Jourden |
| 6,516,571 | B1 | 2/2003 | Overthun et al. |
| 6,520,353 | B2 | 2/2003 | Fulbright |
| 6,523,795 | B2 | 2/2003 | Gutgsell |
| 6,527,235 | B1 | 3/2003 | Cotterill |
| 6,530,181 | B1 | 3/2003 | Seiber |
| 6,533,019 | B1 | 3/2003 | King |
| 6,536,147 | B1 | 3/2003 | Funk et al. |
| 6,536,858 | B1 | 3/2003 | Heidmann |
| D473,723 | S | 4/2003 | Pesso |
| D473,850 | S | 4/2003 | Rouleau et al. |
| 6,540,549 | B2 | 4/2003 | Rupert |
| 6,547,086 | B1 | 4/2003 | Harvey |
| 6,550,875 | B1 | 4/2003 | Compton |
| 6,553,731 | B2 | 4/2003 | Hsueh |
| 6,553,919 | B1 | 4/2003 | Nevin |
| D474,287 | S | 5/2003 | Gresham et al. |
| 6,557,191 | B2 | 5/2003 | Bellows |
| 6,557,310 | B2 | 5/2003 | Marshall |
| 6,559,829 | B1 | 5/2003 | Matsuo |
| 6,560,094 | B2 | 5/2003 | Schmidt |
| 6,564,941 | B2 | 5/2003 | Hedges |
| 6,568,335 | B2 | 5/2003 | Hamilton |
| 6,571,519 | B1 | 6/2003 | Diffrient et al. |
| 6,578,498 | B1 | 6/2003 | Draudt |
| 6,581,344 | B1 | 6/2003 | Niewiadomski |
| 6,588,346 | B1 | 7/2003 | Bockheim |
| 6,595,227 | B2 | 7/2003 | Le Gette |
| 6,609,465 | B2 | 8/2003 | Kolavo |
| 6,615,550 | B2 | 9/2003 | Reuschel |
| 6,617,676 | B1 | 9/2003 | Oddou |
| 6,622,771 | B2 | 9/2003 | Plockmeyer |
| D480,883 | S | 10/2003 | Williams et al. |
| 6,629,505 | B1 | 10/2003 | Cronk |
| D482,535 | S | 11/2003 | Williams et al. |
| 6,644,329 | B2 | 11/2003 | Tomason |
| 6,647,652 | B1 | 11/2003 | Seiber et al. |
| 6,659,023 | B2 | 12/2003 | Saltzman et al. |
| 6,659,546 | B2 | 12/2003 | Schmeing et al. |
| 6,662,731 | B2 | 12/2003 | Teppo |
| 6,662,732 | B2 | 12/2003 | Birsel |
| 6,663,201 | B2 | 12/2003 | Herron, III |
| 6,666,342 | B1 | 12/2003 | House |
| D484,709 | S | 1/2004 | Cronk et al. |
| D485,086 | S | 1/2004 | Gomez |
| 6,672,011 | B2 | 1/2004 | Garner |
| 6,676,231 | B1 | 1/2004 | Kelley et al. |
| 6,682,256 | B1 | 1/2004 | Hor |
| 6,687,930 | B1 | 2/2004 | Eads |
| 6,712,008 | B1 | 3/2004 | Habenicht |
| 6,712,433 | B2 | 3/2004 | Hellwig |
| 6,715,837 | B2 | 4/2004 | Niederman |
| 6,725,784 | B2 | 4/2004 | Crinion |
| 6,726,277 | B1 | 4/2004 | Samaha |
| 6,729,085 | B2 | 5/2004 | Newhouse |
| 6,736,076 | B2 | 5/2004 | Kaltenmark |
| 6,739,096 | B2 | 5/2004 | Feldpausch |
| 6,742,307 | B2 | 6/2004 | Briskman |
| 6,742,461 | B1 | 6/2004 | Sen |
| 6,748,710 | B2 | 6/2004 | Gresham |
| 6,749,001 | B2 | 6/2004 | Peppett |
| 6,749,074 | B1 | 6/2004 | Hileman |
| 6,749,161 | B1 | 6/2004 | Will |
| 6,751,914 | B2 | 6/2004 | Zeh |
| 6,754,998 | B2 | 6/2004 | Diffrient et al. |
| 6,758,355 | B2 | 7/2004 | Zidek |
| 6,764,245 | B2 | 7/2004 | Popovski |
| 6,765,148 | B2 | 7/2004 | Rix |
| 6,766,748 | B2 | 7/2004 | Insalaco |
| 6,769,747 | B2 | 8/2004 | Chan |
| D495,514 | S | 9/2004 | Ricci |
| D495,518 | S | 9/2004 | Ricci |
| 6,786,161 | B2 | 9/2004 | Fischer |
| 6,786,340 | B2 | 9/2004 | Ford |
| 6,792,876 | B2 | 9/2004 | Lin |
| 6,796,443 | B2 | 9/2004 | Lippman |
| 6,802,264 | B2 | 10/2004 | Kasak |
| 6,802,715 | B1 | 10/2004 | Wotton |
| 6,805,060 | B2 | 10/2004 | Nicoletti |
| 6,807,776 | B2 | 10/2004 | Girdwood |
| D498,074 | S | 11/2004 | Gomez |
| 6,818,305 | B2 | 11/2004 | Murar |
| 6,820,388 | B2 | 11/2004 | Newhouse |
| 6,827,028 | B1 | 12/2004 | Callaway |
| 6,827,320 | B2 | 12/2004 | Yeh |
| 6,829,792 | B2 | 12/2004 | Braly |
| 6,837,384 | B2 | 1/2005 | Secondino |
| 6,845,723 | B2 | 1/2005 | Kottman |
| D501,330 | S | 2/2005 | Gomez |
| 6,851,140 | B2 | 2/2005 | Polevoy |
| 6,851,226 | B2 | 2/2005 | MacGregor |
| 6,854,217 | B2 | 2/2005 | Bockheim et al. |
| 6,854,233 | B2 | 2/2005 | Pitsch et al. |
| 6,857,712 | B1 | 2/2005 | Haberman |
| 6,866,890 | B2 | 3/2005 | Kiryu |
| 6,877,731 | B1 | 4/2005 | Corley, Sr. |
| 6,877,824 | B2 | 4/2005 | Winkless |
| 6,880,185 | B1 | 4/2005 | McAdams |
| D505,456 | S | 5/2005 | Green |
| 6,886,890 | B2 | 5/2005 | Rowland |
| 6,895,634 | B2 | 5/2005 | Tisbo |

(56) References Cited

U.S. PATENT DOCUMENTS

| | | | |
|---|---|---|---|
| 6,895,868 | B1 | 5/2005 | Cronk et al. |
| 6,895,869 | B2 | 5/2005 | Lai |
| 6,899,404 | B1 | 5/2005 | King |
| 6,901,940 | B2 | 6/2005 | Zheng |
| 6,904,719 | B2 | 6/2005 | Braun |
| 6,908,148 | B2 | 6/2005 | Wang et al. |
| 6,910,306 | B2 | 6/2005 | Waalkes et al. |
| 6,912,960 | B2 | 7/2005 | Tsai |
| D508,455 | S | 8/2005 | Oakley et al. |
| 6,928,785 | B2 | 8/2005 | Shipman |
| 6,931,795 | B1 | 8/2005 | Baloga |
| 6,935,247 | B2 | 8/2005 | Schaefers |
| 6,935,517 | B1 | 8/2005 | Reed |
| 6,942,306 | B2 | 9/2005 | Youngs |
| D510,699 | S | 10/2005 | Crain et al. |
| 6,951,085 | B2 | 10/2005 | Hodges |
| 6,957,878 | B2 | 10/2005 | Greenwald |
| 6,968,957 | B2 | 11/2005 | Fynn |
| 6,972,367 | B2 | 12/2005 | Federspiel |
| 6,976,732 | B2 | 12/2005 | Thomas |
| 6,980,259 | B2 | 12/2005 | Strollo |
| 6,986,491 | B2 | 1/2006 | Anderson |
| 6,986,556 | B2 | 1/2006 | Haberman |
| 6,990,909 | B2 | 1/2006 | Gosling |
| D516,101 | S | 2/2006 | Vardon |
| D516,227 | S | 2/2006 | Price |
| 7,004,081 | B2 | 2/2006 | Chang |
| 7,007,903 | B2 | 3/2006 | Turner |
| 7,008,031 | B2 | 3/2006 | Doerflinger |
| 7,014,052 | B2 | 3/2006 | Dettorre |
| 7,020,911 | B2 | 4/2006 | Oldham |
| 7,025,424 | B2 | 4/2006 | Harley |
| 7,032,523 | B2 | 4/2006 | Forslund, III |
| D520,263 | S | 5/2006 | Nobles et al. |
| 7,036,438 | B2 | 5/2006 | Okamoto |
| 7,040,700 | B2 | 5/2006 | Duncan |
| 7,048,333 | B2 | 5/2006 | Martinez |
| 7,048,346 | B2 | 5/2006 | Saravis |
| 7,051,482 | B2 | 5/2006 | MacDonald et al. |
| 7,066,097 | B2 | 6/2006 | Gayhart et al. |
| 7,066,098 | B2 | 6/2006 | Blasen |
| 7,066,435 | B2 | 6/2006 | Oddsen, Jr. |
| 7,070,156 | B2 | 7/2006 | Liao |
| 7,075,101 | B2 | 7/2006 | Iiyama |
| 7,077,068 | B1 | 7/2006 | Agee |
| 7,096,560 | B2 | 8/2006 | Oddsen, Jr. |
| 7,100,999 | B2 | 9/2006 | Stravitz |
| D530,929 | S | 10/2006 | Resterhouse et al. |
| D531,225 | S | 10/2006 | Kent et al. |
| 7,114,972 | B1 | 10/2006 | Riner |
| 7,117,802 | B2 | 10/2006 | Hoke, Jr. |
| 7,125,088 | B2 | 10/2006 | Haberman |
| 7,140,134 | B1 | 11/2006 | Flagg |
| D533,365 | S | 12/2006 | Martin |
| 7,152,918 | B2 | 12/2006 | Berkes |
| 7,159,053 | B1 | 1/2007 | Lakin |
| D537,532 | S | 2/2007 | Takeuchi et al. |
| 7,172,166 | B2 | 2/2007 | Wang |
| 7,175,152 | B2 | 2/2007 | Dittmer |
| 7,182,415 | B2 | 2/2007 | Yamada |
| D538,054 | S | 3/2007 | Lissoni |
| D539,047 | S | 3/2007 | Auberger |
| 7,185,767 | B2 | 3/2007 | Phillips |
| 7,191,713 | B2 | 3/2007 | Gayhart |
| 7,195,119 | B2 | 3/2007 | Lungo |
| 7,201,107 | B1 | 4/2007 | Ruiter |
| D543,404 | S | 5/2007 | Watkins et al. |
| 7,210,593 | B2 | 5/2007 | Stull |
| D544,062 | S | 6/2007 | Baker |
| 7,225,822 | B1 | 6/2007 | Zheng |
| 7,228,977 | B2 | 6/2007 | Perkins |
| 7,237,855 | B2 | 7/2007 | Vardon |
| 7,241,981 | B2 | 7/2007 | Hofmann |
| 7,249,624 | B2 | 7/2007 | Zeh |
| D549,470 | S | 8/2007 | Hutton |
| 7,252,339 | B2 | 8/2007 | Owens |
| 7,270,309 | B2 | 9/2007 | Burns |
| 7,273,203 | B2 | 9/2007 | Carnevali |
| 7,278,360 | B2 | 10/2007 | Griepentrog |
| D554,387 | S | 11/2007 | Nicoletti |
| 7,290,651 | B2 | 11/2007 | Irwin |
| 7,300,029 | B2 | 11/2007 | Petrick |
| 7,303,417 | B2 | 12/2007 | Lubkert |
| 7,325,343 | B2 | 2/2008 | Seiber |
| 7,334,762 | B2 | 2/2008 | Dittmer |
| D564,764 | S | 3/2008 | Springer et al. |
| 7,343,864 | B2 | 3/2008 | Canin |
| D565,849 | S | 4/2008 | Newhouse |
| 7,357,086 | B2 | 4/2008 | Petrick |
| D568,344 | S | 5/2008 | Baacke et al. |
| D569,105 | S | 5/2008 | Van Hoorn |
| D569,142 | S | 5/2008 | Burak |
| 7,369,401 | B1 | 5/2008 | Floersch |
| 7,370,907 | B2 | 5/2008 | Leong |
| 7,377,078 | B2 | 5/2008 | Golino |
| 7,389,564 | B2 | 6/2008 | Lautenschläger |
| D573,820 | S | 7/2008 | Burak |
| 7,406,803 | B2 | 8/2008 | Haberman |
| 7,408,114 | B2 | 8/2008 | VanderVelde |
| 7,411,126 | B2 | 8/2008 | Herzog |
| 7,428,872 | B2 | 9/2008 | Strong |
| 7,433,618 | B2 | 10/2008 | Bartley |
| 7,434,304 | B2 | 10/2008 | Owens |
| 7,441,739 | B2 | 10/2008 | Huang |
| 7,461,484 | B2 | 12/2008 | Battey |
| 7,469,090 | B2 | 12/2008 | Ferris |
| D584,524 | S | 1/2009 | Ricci |
| D584,900 | S | 1/2009 | Hackethal et al. |
| D585,218 | S | 1/2009 | Hamilton et al. |
| 7,472,656 | B2 | 1/2009 | Riach |
| 7,481,502 | B2 | 1/2009 | Ortiz |
| 7,513,470 | B2 | 4/2009 | Lomberk |
| 7,516,708 | B2 | 4/2009 | Willy |
| 7,516,854 | B2 | 4/2009 | Brown |
| 7,516,929 | B2 | 4/2009 | Brustein |
| 7,517,029 | B2 | 4/2009 | Cvek |
| 7,520,076 | B2 | 4/2009 | Flagg |
| 7,523,903 | B1 | 4/2009 | Rindoks |
| 7,527,331 | B2 | 5/2009 | Fargason, III |
| 7,530,651 | B2 | 5/2009 | Ho |
| 7,544,893 | B2 | 6/2009 | Wallgren |
| D595,865 | S | 7/2009 | Magnusson |
| D596,876 | S | 7/2009 | Oshinomi et al. |
| D596,878 | S | 7/2009 | Oshinomi |
| D597,345 | S | 8/2009 | Oshinomi et al. |
| 7,575,011 | B2 | 8/2009 | Zheng |
| 7,578,399 | B1 | 8/2009 | Mulaw |
| D599,122 | S | 9/2009 | Feldpausch et al. |
| 7,586,041 | B2 | 9/2009 | VanderVelde |
| 7,591,385 | B2 | 9/2009 | Brooks |
| 7,594,700 | B2 | 9/2009 | Stumpf |
| 7,594,823 | B2 | 9/2009 | Moscovitch |
| D602,706 | S | 10/2009 | Cramer et al. |
| D603,065 | S | 10/2009 | Hamilton et al. |
| 7,607,625 | B2 | 10/2009 | Wang |
| D603,617 | S | 11/2009 | Weiss |
| 7,614,350 | B2 | 11/2009 | Tuttle |
| 7,621,421 | B2 | 11/2009 | Ohayon |
| 7,621,489 | B2 | 11/2009 | Cvek |
| 7,621,500 | B2 | 11/2009 | Ishizaki |
| 7,624,959 | B2 | 12/2009 | Dozier |
| D608,407 | S | 1/2010 | Medlock |
| 7,641,056 | B2 | 1/2010 | Schulman |
| 7,644,456 | B2 | 1/2010 | Polevoy |
| 7,658,199 | B2 | 2/2010 | Ayers |
| 7,665,255 | B2 | 2/2010 | Dressendorfer |
| 7,665,709 | B2 | 2/2010 | Cvek |
| 7,673,838 | B2 | 3/2010 | Oddsen, Jr. |
| 7,676,992 | B2 | 3/2010 | Burns |
| 7,677,182 | B2 | 3/2010 | Mueller |
| 7,686,172 | B2 | 3/2010 | Wisnoski |
| 7,694,925 | B2 | 4/2010 | Kokenge |
| 7,697,268 | B2 | 4/2010 | Johnson |
| 7,703,398 | B2 | 4/2010 | Bräuning |

(56) References Cited

U.S. PATENT DOCUMENTS 7,703,469 B2 4/2010 Danziger
D614,844 S 5/2010 Trunfio
D615,308 S 5/2010 Serra Sola et al.
7,721,361 B1 5/2010 Shubert
D616,663 S 6/2010 Natuzzi
D617,112 S 6/2010 Tsai
7,726,617 B2 6/2010 Zambelli
7,735,167 B2 6/2010 Kline
7,740,048 B2 6/2010 Wilson
7,740,310 B1 6/2010 Forster
7,753,063 B1 7/2010 Laws
7,757,869 B2 7/2010 Lawson
7,765,651 B2 8/2010 Seth
D624,084 S 9/2010 Scheper et al.
7,798,463 B2 9/2010 Morgenroth
7,802,407 B2 9/2010 Haberman
7,810,654 B1 10/2010 Wang
7,827,920 B2 11/2010 Beck
7,832,147 B2 11/2010 Weast
D628,403 S 12/2010 Starck
7,856,756 B1 12/2010 Caruso
7,871,048 B2 1/2011 Sculler
7,871,131 B2 1/2011 Rowland
7,878,476 B2 2/2011 Carson
7,891,617 B2 2/2011 Tisbo
7,896,015 B2 3/2011 Milano, Jr.
7,900,781 B2 3/2011 Baine
7,900,783 B2 3/2011 Fernandez
7,905,242 B2 3/2011 Kline
7,909,400 B1 3/2011 Delaney
7,921,615 B2 4/2011 Picchio
7,942,100 B2 5/2011 Grove
8,015,765 B2 9/2011 Stackenwalt
D649,807 S 12/2011 Stoepker
D651,416 S 1/2012 Martin et al.
8,109,215 B2 2/2012 Kitada et al.
D655,541 S 3/2012 Zemel
8,196,526 B2 * 6/2012 Rheault ..... A47B 13/10 108/50.01
8,225,723 B2 7/2012 Nakamura et al.
8,276,523 B2 10/2012 Miller et al.
8,534,752 B2 9/2013 Martin et al.
8,667,908 B2 3/2014 Martin et al.
8,689,705 B2 4/2014 Martin et al.
8,960,102 B2 2/2015 Rheault et al.
9,125,486 B2 9/2015 Rheault et al.
9,185,974 B2 * 11/2015 Martin ..... A47B 13/02
9,210,999 B2 12/2015 Martin et al.
2001/0013305 A1 8/2001 Funk et al.
2002/0062933 A1 5/2002 Insalaco et al.
2002/0069794 A1 6/2002 Dame et al.
2002/0189170 A1 12/2002 Reuschel et al.
2003/0005863 A1 1/2003 Chen
2003/0056817 A1 3/2003 Miller et al.
2003/0070595 A1 4/2003 Crinion
2003/0089283 A1 5/2003 Okamoto et al.
2003/0136313 A1 7/2003 Griepentrog
2003/0140985 A1 7/2003 Wang
2003/0182871 A1 10/2003 Gersham et al.
2003/0182885 A1 10/2003 Gersham et al.
2003/0213415 A1 11/2003 Ross et al.
2003/0222545 A1 12/2003 Stravitz
2004/0052053 A1 3/2004 Lee et al.
2004/0060485 A1 4/2004 Chang
2004/0066626 A1 4/2004 Lee et al.
2004/0149177 A1 8/2004 Gayhart et al.
2004/0194669 A1 10/2004 Forslund, III et al.
2004/0231570 A1 11/2004 Landa
2004/0239217 A1 12/2004 Patel
2004/0250480 A1 12/2004 Matthai
2004/0250739 A1 12/2004 Yang
2005/0028272 A1 2/2005 Kanthasamy
2005/0045073 A1 3/2005 Wasley
2005/0056308 A1 3/2005 Birchenough
2005/0115178 A1 6/2005 Schmidt
2005/0126447 A1 6/2005 Smith et al.
2005/0263041 A1 12/2005 Mueller et al.
2005/0268823 A1 12/2005 Bakker et al.
2005/0280339 A1 12/2005 Perkins et al.
2005/0284341 A1 12/2005 Klassy et al.
2006/0010787 A1 1/2006 Hand et al.
2006/0042520 A1 3/2006 Stevens et al.
2006/0080817 A1 4/2006 Klinker
2006/0096506 A1 5/2006 Brauning et al.
2006/0108299 A1 5/2006 Menard
2006/0162065 A1 7/2006 Glattstein et al.
2006/0162626 A1 7/2006 Brauning et al.
2006/0163003 A1 7/2006 Wigstrom, Sr.
2006/0179792 A1 8/2006 Shaw et al.
2006/0266900 A1 11/2006 May et al.
2006/0278777 A1 12/2006 Atkinson et al.
2007/0017888 A1 1/2007 Falvey et al.
2007/0018486 A1 1/2007 Ayers et al.
2007/0018543 A1 1/2007 Cribbs
2007/0039150 A1 2/2007 Thomas et al.
2007/0057000 A1 3/2007 Webster
2007/0062992 A1 3/2007 Hepworth et al.
2007/0095374 A1 5/2007 Gendriesch et al.
2007/0114350 A1 5/2007 Sorci
2007/0114892 A1 5/2007 Boxenbaum et al.
2007/0170823 A1 7/2007 Stannis et al.
2007/0204537 A1 9/2007 Bastian et al.
2007/0221795 A1 9/2007 Cutty
2007/0251428 A1 11/2007 Mead et al.
2007/0277710 A1 12/2007 Gray et al.
2007/0277711 A1 12/2007 Grant
2007/0283631 A1 12/2007 Grandin et al.
2008/0010935 A1 1/2008 Nagel et al.
2008/0035031 A1 2/2008 Yamanishi et al.
2008/0041281 A1 2/2008 Griepentrog
2008/0050173 A1 2/2008 Bruder et al.
2008/0053931 A1 3/2008 Newbould et al.
2008/0074014 A1 3/2008 Ho
2008/0078310 A1 4/2008 VanNimwegen et al.
2008/0099279 A1 5/2008 Griswold et al.
2008/0149001 A1 6/2008 Hodges et al.
2008/0223658 A1 9/2008 Michalec
2008/0224580 A1 9/2008 Gibbs et al.
2008/0276841 A1 11/2008 Brauning et al.
2008/0289545 A1 11/2008 Picchio
2008/0290768 A1 11/2008 Haberman
2008/0295745 A1 12/2008 Hamilton et al.
2008/0296245 A1 12/2008 Punzel et al.
2008/0296457 A1 12/2008 Hager et al.
2009/0001859 A1 1/2009 Compton et al.
2009/0013908 A1 1/2009 Grove et al.
2009/0014401 A1 1/2009 Tallman
2009/0039685 A1 2/2009 Zernov
2009/0042428 A1 2/2009 Henriott et al.
2009/0051254 A1 2/2009 Grove
2009/0133609 A1 5/2009 Nethken et al.
2009/0165680 A1 7/2009 Bakker et al.
2009/0260547 A1 10/2009 Epstein et al.
2009/0273260 A1 11/2009 Kemp
2009/0282663 A1 11/2009 Martin et al.
2009/0284111 A1 11/2009 Hazzard et al.
2009/0293391 A1 12/2009 DeVore
2009/0293402 A1 12/2009 Hamilton et al.
2009/0309464 A1 12/2009 Schwartz
2009/0314913 A1 12/2009 Gillis
2010/0000449 A1 1/2010 Botkin
2010/0045081 A1 2/2010 Efthimiou
2010/0073919 A1 3/2010 Shame
2010/0096349 A1 4/2010 Schulman
2010/0126394 A1 5/2010 Burak et al.
2010/0181030 A1 7/2010 Smoyer et al.
2010/0187785 A1 * 7/2010 Knappe ..... A61G 12/001 280/47.34
2010/0212139 A1 8/2010 Oddsen, Jr. et al.
2010/0270246 A1 10/2010 Rodriguez
2010/0326930 A1 12/2010 Chiang
2010/0327134 A1 12/2010 Lundrigan et al.
2011/0297051 A1 12/2011 Martin et al.

(56) References Cited

U.S. PATENT DOCUMENTS

| | | | | |
|---|---|---|---|---|
| 2011/0297053 | A1* | 12/2011 | Martin | A47B 13/003 108/42 |
| 2012/0103726 | A1 | 5/2012 | Morfidis et al. | |
| 2012/0298017 | A1 | 11/2012 | Chen | |
| 2014/0238277 | A1* | 8/2014 | Fishman | A47B 37/00 108/25 |
| 2014/0312754 | A1* | 10/2014 | Hecht | A47B 9/04 312/309 |
| 2014/0360413 | A1* | 12/2014 | Schenk | A47B 87/002 108/50.11 |

FOREIGN PATENT DOCUMENTS

| | | | |
|---|---|---|---|
| CN | 2919992 | Y | 7/2007 |
| CN | 101301147 | A | 11/2008 |
| CN | 101420882 | A | 4/2009 |
| DE | 1764779 | U | 4/1958 |
| DE | 8623882 | U1 | 11/1986 |
| DE | 8707366 | U1 | 7/1987 |
| DE | 3625137 | C1 | 10/1987 |
| DE | 9412469 | U1 | 10/1994 |
| DE | 19733435 | A1 | 2/1999 |
| DE | 19848392 | C1 | 12/1999 |
| DE | 202006016372 | U1 | 11/2007 |
| EP | 0096272 | A2 | 12/1983 |
| EP | 0145410 | A2 | 6/1985 |
| EP | 0147902 | A2 | 7/1985 |
| EP | 0164041 | A2 | 12/1985 |
| EP | 0244582 | A2 | 11/1987 |
| EP | 0447961 | A2 | 9/1991 |
| EP | 0462920 | A1 | 12/1991 |
| EP | 0594939 | A1 | 5/1994 |
| EP | 0791311 | A1 | 8/1997 |
| EP | 0815775 | A2 | 1/1998 |
| EP | 0830825 | A2 | 3/1998 |
| EP | 0903139 | A1 | 3/1999 |
| EP | 0949394 | A1 | 10/1999 |
| EP | 1647205 | A1 | 4/2006 |
| FR | 1232788 | A | 10/1960 |
| FR | 2636511 | A1 | 3/1990 |
| FR | 2865486 | A1 | 7/2005 |
| GB | 2048351 | A | 12/1980 |
| GB | 2100121 | A | 12/1982 |
| GB | 2246801 | A | 2/1992 |
| GB | 2323781 | A | 10/1998 |
| JP | 2002100889 | A | 4/2002 |
| JP | 2003111623 | A | 4/2003 |
| JP | 2004237398 | A | 8/2004 |
| JP | 2004275314 | A | 10/2004 |
| JP | 2004313251 | A | 11/2004 |
| JP | 2005087625 | A | 4/2005 |
| JP | 2005287620 | A | 10/2005 |
| JP | 2008023195 | A | 2/2008 |
| JP | 2008142337 | A | 6/2008 |
| JP | 2008289634 | A | 12/2008 |
| JP | 2009082528 | A | 4/2009 |
| JP | 2009095360 | A | 5/2009 |
| WO | 9609782 | A1 | 4/1996 |
| WO | 9713431 | A1 | 4/1997 |
| WO | 9719617 | A2 | 6/1997 |
| WO | 9801056 | A1 | 1/1998 |
| WO | 9807357 | A1 | 2/1998 |
| WO | 9902071 | A1 | 1/1999 |
| WO | 9960889 | A2 | 12/1999 |
| WO | 03047400 | A2 | 6/2003 |
| WO | 2004021830 | A1 | 3/2004 |
| WO | 2005093197 | A1 | 10/2005 |
| WO | 2005098159 | A2 | 10/2005 |
| WO | 2005120288 | A1 | 12/2005 |
| WO | 2006029895 | A1 | 3/2006 |
| WO | 2008041873 | A2 | 4/2008 |
| WO | 2008150717 | A2 | 12/2008 |
| WO | 2009052656 | A1 | 4/2009 |
| WO | 2009154983 | A2 | 12/2009 |

OTHER PUBLICATIONS

PCT International Preliminary Report on Patentability, PCT/US2008/064457, dated Dec. 1, 2009.
PCT International Search Report and Written Opinion, PCT/US2011/038904, dated Nov. 23, 2011.
PCT International Search Report and Written Opinion, PCT/US2011/038899, dated Nov. 23, 2011.
PCT International Search Report and Written Opinion, PCT/US2011/038892, dated Nov. 24, 2011.
The State Intellectual Property Office of the People's Republic of China, First Office Action and Search Report, Application No. 201180027125.8, dated Jul. 30, 2014, 16 pages.
The State Intellectual Property Office of the People's Republic of China, Second Office Action, Application No. 201180027125.8, dated May 6, 2015, 2014, 7 pages.
The State Intellectual Property Office of the People's Republic of China, Third Office Action, Application No. 201180027125.8, dated Sep. 28, 2015, 5 pages.
The State Intellectual Property Office of the People's Republic of China, First Office Action and Search Report, Application No. 201180026938.5, dated Jun. 20, 2014, 14 pages.
The State Intellectual Property Office of the People's Republic of China, Second Office Action, Application No. 201180026938.5, dated Jan. 29, 2015, 7 pages.
European Patent Office, Examination Report, Application No. 11725579.4, dated Oct. 9, 2013.
European Patent Office, Further Examination Report, Application No. 11725579.4, dated Mar. 17, 2014.
European Patent Office, Further Examination Report, Application No. 11725579.4, dated Feb. 5, 2015.
European Patent Office, Examination Report, Application No. 11726566.0, dated Sep. 24, 2013.
European Patent Office, Further Examination Report, Application No. 11726566.0, dated Mar. 31, 2014.
European Patent Office, Extended European Search Report, Application No. 14157546.4, dated May 15, 2014.
European Patent Office, Examination Report, Application No. 14157546.4, dated Feb. 26, 2015.
European Patent Office, Summons to Attend Oral Proceedings with Accompanying Communication, Application No. 14157546.4, dated Sep. 2, 2015.
European Patent Office, Extended European Search Report, Application No. 14162832.1, dated Apr. 24, 2014.
European Patent Office, Examination Report, Application No. 14162832.1, dated Apr. 23, 2015.
European Patent Office, Examination Report, Application No. 14162832.1, dated Nov. 25, 2015.
European Patent Office, Communication, Application No. 14162832.1, dated Apr. 13, 2016.
European Patent Office, Extended European Search Report, Application No. 14166432.6, dated May 26, 2014.
Unifor Misura St Catalog, 1986.
Unifor Luca Meda Catalog.
Unifor Pannelli PL Catalog.
Unifor Progetto 25.90 Catalog, 1991.
Canadian Intellectual Property Office, Office Action, Application No. 2,799,938, dated Mar. 20, 2017.
Canadian Intellectual Property Office, Office Action, Application No. 2,799,962, dated Mar. 24, 2017.
Canadian Intellectual Property Office, Office Action, Application No. 2,800,009, dated Mar. 24, 2017.
Canadian Intellectual Property Office, Office Action, Application No. 2,741,905, dated Apr. 5, 2017.
Canadian Intellectual Property Office, Office Action, Application No. 2,741,884, dated Apr. 6, 2017.
United States Patent and Trademark Office, Office Action Summary and Detailed Action, U.S. Appl. No. 14/816,658, dated Apr. 5, 2017.
Applicant, Response to United States Patent and Trademark Office dated Apr. 5, 2017, Office Action Summary and Detailed Action, U.S. Appl. No. 14/816,658, dated Jul. 5, 2017.
United States Patent and Trademark Office, Office Action Summary and Detailed Action, U.S. Appl. No. 14/934,426, dated May 3, 2017.

(56) References Cited

OTHER PUBLICATIONS

PCT International Search Report and Written Opinion, PCT/US2017/032700, dated Aug. 18, 2017, 15 pages.

* cited by examiner

MULTI-TIERED WORKSTATION ASSEMBLY

CROSS-REFERENCE TO RELATED APPLICATIONS

This application claims the benefit of U.S. Patent Application Ser. No. 62/339,159, filed on May 20, 2016, and claims the benefit of U.S. Patent Application Ser. No. 62/336,042, filed on May 13, 2016, which are incorporated herein by reference in their entireties. This application is also related to U.S. Design patent application Ser. No. 29/565,485 filed on May 20, 2016, which is also incorporated herein by reference in its entirety.

BACKGROUND OF THE INVENTION

The present invention relates to workstations generally and more specifically to a multi-tiered workstation that includes work surfaces mounted at different heights that can be used simultaneously to accommodate both sitting and standing users.

In an increasingly technological world, people often sit for many hours a day working on computers or other electronic devices. Researchers have found, however, that excessive sitting can result not only in reduced productivity, but medical problems, including discomfort in various parts of the body, permanent deficiencies or serious illnesses. Office furniture that enables a worker to stand during at least a portion of the day, therefore, has become increasingly popular, both to increase productivity and improve worker health.

With advances in mobile technology, people are also increasingly working and accessing electronic devices from a variety of locations, including airports, coffee shops, and libraries. In these environments, temporary work stations that provide work surfaces and access to electrical and network connections that enable a user to connect tablets, notebook computers, phones or other personal electronic and computing devices are important. In these environments, maximizing efficient workspace while minimizing the use of floor space is also important.

Similarly, in locations such as retail establishments or medical facilities, workstations are often used by a number of workers simultaneously, and provide work surfaces for a variety of uses. A single workstation can, for example, function as a reception desk while also providing a space for users to fill out paperwork, answer phone calls, or access computer databases containing patient date, or stock information. These workstations, again, should generally be small in size, take up a minimal amount of floor space, and provide surfaces of varying heights for both sitting and standing users.

There is a need, therefore, for inexpensive, flexible, and comfortable workstations that can be quickly adjusted to the needs of a user. There is also a need for a workstation that provides multiple work surfaces at different height levels and that allow workers to both sit and stand. There is a further need for a workstation that fits within a small footprint and requires limited floor space, while enabling users to connect to electrical and network facilities, and to work in both standing and sitting positions. The present disclosure addresses these and other issues.

BRIEF SUMMARY OF THE INVENTION

It has been recognized that a multi-surface, dual height workstation can be configured to include standing and sitting height work surfaces where each of the surfaces can be accessed for use simultaneously. The system can provide a number of work surfaces within a small footprint. In some applications, the desk can be part of a reconfigurable system constructed on a core frame that can be easily assembled and disassembled.

In one aspect, the present disclosure provides a multi-tiered work surface comprising a substantially vertical mounting element. A first planar surface is supported by the substantially vertical mounting element in a substantially horizontal orientation at a first height, and a second planar surface is supported by the substantially vertical mounting element in a substantially horizontal orientation at a second height lower than the first height. The first planar surface comprises a substantially straight edge along a length dimension and an opposing edge comprising a wide end and a narrow end along a depth dimension. A width in at least a portion of the wide end is greater than a width in at least a portion of the narrow end. The second planar surface comprises a substantially straight edge along a length dimension and an opposing edge comprising a wide end and a narrow end along a depth dimension. Again, a width in at least a portion of the wide end is greater than a width in at least a portion of the narrow end. The wide end of the first surface is supported above the narrow end of the second surface, and the wide end of the second surface is supported beneath the narrow end of the first surface. The narrow end of the second surface is supported beneath the wide end of the first surface. The first planar surface therefore provides a work surface at the wide end accessible to a user at the first height, and the second planar surface provides a work surface at the wide end accessible to a user at the second height.

In another aspect of the disclosure, the multi-tiered work surface further comprises a second substantially vertical mounting element offset a distance from the substantially vertical mounting element. The first and second planar surfaces extend at least partially between the vertical mounting element and the second vertical mounting element.

The multi-tiered work surface can also include a third and a fourth planar surface, each comprising a substantially straight edge along a length dimension and an opposing edge comprising a wide end and a narrow end along a depth dimension. At least a portion of the wide end is greater in width than at least a portion of the narrow end. The third planar surface is supported by the vertical mounting element at a third height, and the fourth planar surface is supported by the vertical mounting element at a fourth height. The wide end of the third planar surface extends above the narrow end of the fourth planar surface, such that the third planar surface provides a work surface at the wide end accessible to a user at the third height and the fourth planar surface provides a work surface at the wide end accessible to a user at the fourth height.

In another aspect, the wide end and the narrow end of each of the first and second planar surfaces can be substantially equivalent in length. Alternatively, the wide end and the narrow end can be offset in such a way that the wide and narrow surfaces that are intended to overlap in stacked layers of work surfaces align. The first and second planar surfaces can comprise an angled segment extending between the wide end and the narrow end.

In another aspect, the substantially straight edge of the first planar surface can be coupled to the vertical mounting element facing the substantially straight edge of the third planar surface, and the straight edge of the second planar surface can be coupled to the vertical mounting element facing the substantially straight edge of the fourth planar surface coupled to the vertical mounting element.

In another aspect, a substantially vertical planar surface can extend between the first and third planar surfaces to provide a privacy shield between a first side of the multi-tiered work surface and a second side of the multi-tiered work surface.

In another aspect, the substantially vertical mounting element can comprise a pre-defined mounting point for coupling the first and second planar surfaces at the corresponding first and second heights. The substantially vertical mounting element can comprise a plurality of pre-determined mounting points at a corresponding plurality of heights.

The vertical mounting element can, for example, comprises a horizontal rail corresponding to the first height and a second horizontal rail corresponding to the second height. The first height can be, for example, a sitting height, and the second height can be a standing height.

In another embodiment of the disclosure, an arrangement with multi-height work surfaces is disclosed. The arrangement comprises a leg arrangement configured to be supported on a ground or floor surface, and the leg arrangement comprises a first attachment feature at a first height above the ground surface and a second attachment feature at a second height above the ground surface. The second height is greater than the first height. A first work surface coupled to the first attachment feature and has a first footprint relative to the ground surface. A second work surface is coupled to the second attachment feature and has a second footprint relative to the ground surface. The first footprint and the second footprint are distinct, and the space between the floor and the second work surface is at least partially unobstructed by the first work surface.

A second leg arrangement with a third attachment feature can be provided at the first height above the ground surface and a fourth attachment feature can be provided at the second height above the ground. The first work surface is adapted to be coupled to the third attachment feature and the second work surface is adapted to be coupled to the fourth attachment feature.

In another aspect, the second work surface can be co-planar with a top surface of the leg arrangement. The first height can selected to be at a height for using the first work surface while sitting. The second height can be selected to be at a height for using the second work surface while standing. A wide portion of the second footprint is adapted to stack above a narrow portion of the first footprint, and a narrow portion of the second footprint is adapted to stack above a wide portion of the first footprint, wherein access to the wide portion of each of the first and second work surfaces is unobstructed for use.

In another aspect, a multi-height work arrangement is disclosed, comprising a frame comprising a first leg assembly, a second leg assembly, an upper support beam and a lower support beam, both of the support beams extending between the first leg assembly and the second leg assembly. A standing height work surface having a length running adjacent the upper support beam is coupled to at least the first leg assembly and the upper support beam. A sitting height work surface having a length running adjacent the lower support beam is coupled to at least the second leg assembly and the lower support beam. A depth of the standing height work surface is greatest adjacent the first leg assembly and a depth of the sitting height work surface is greatest adjacent the second leg assembly.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF THE INVENTION

One or more specific embodiments of the present invention will be described below. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
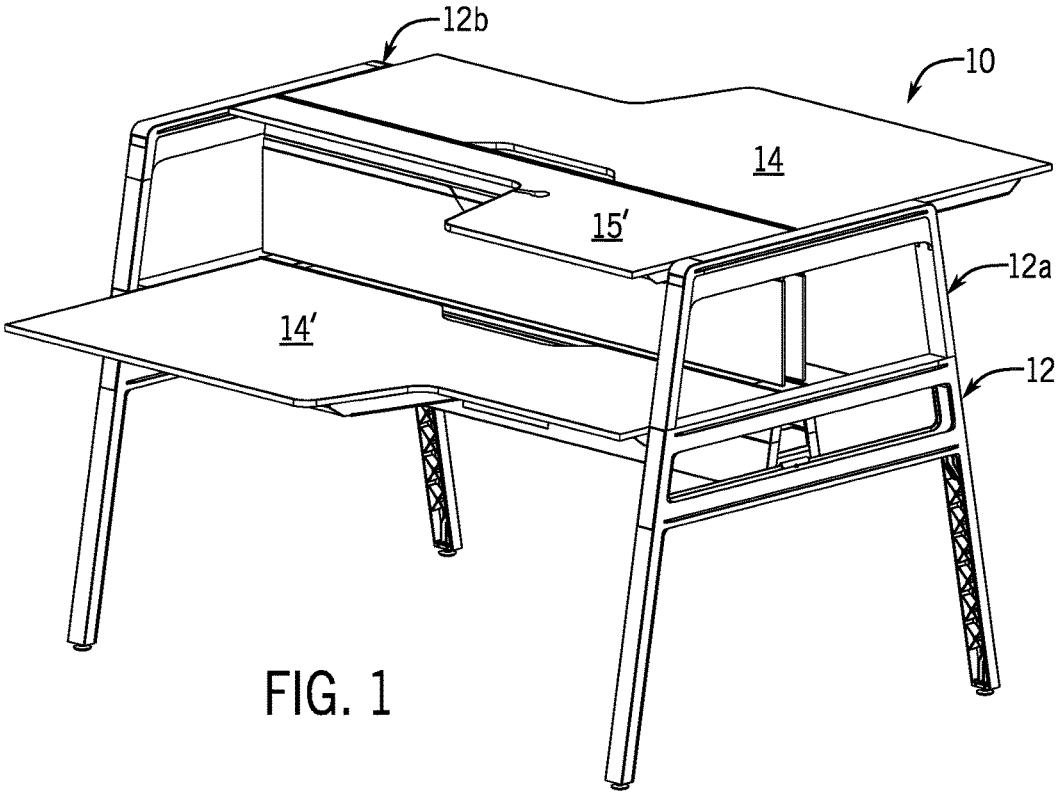
FIG. 1 is a side perspective view of a multi-tiered work station constructed in accordance with one embodiment of the disclosure.
Figure 2:
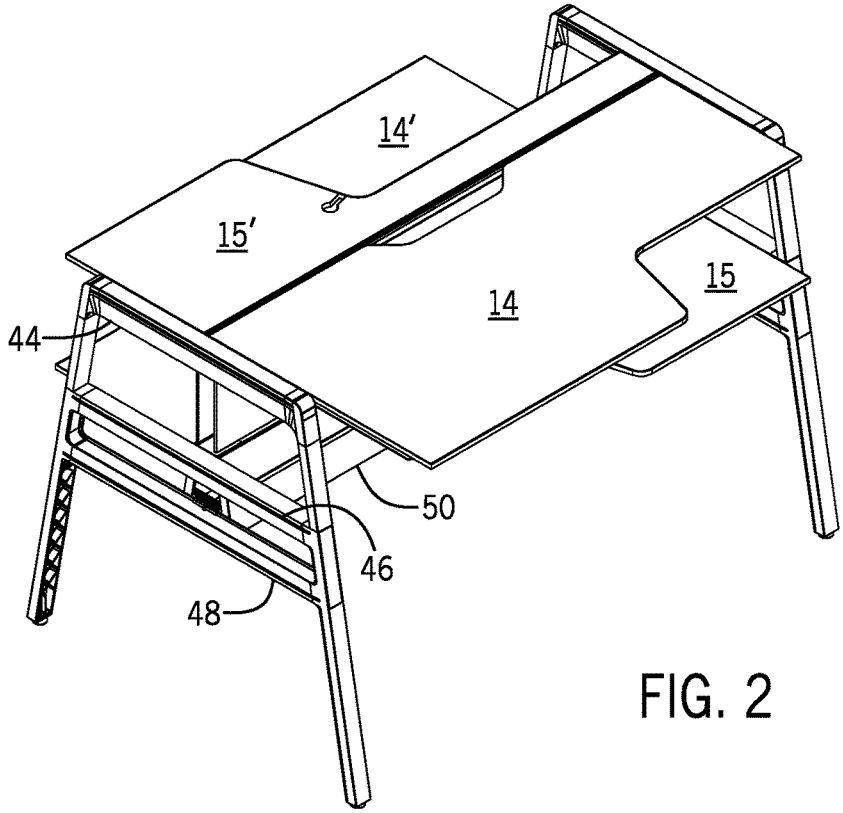
FIG. 2 is a top perspective view of the multi-tiered work station of FIG. 1.
Figure 3:
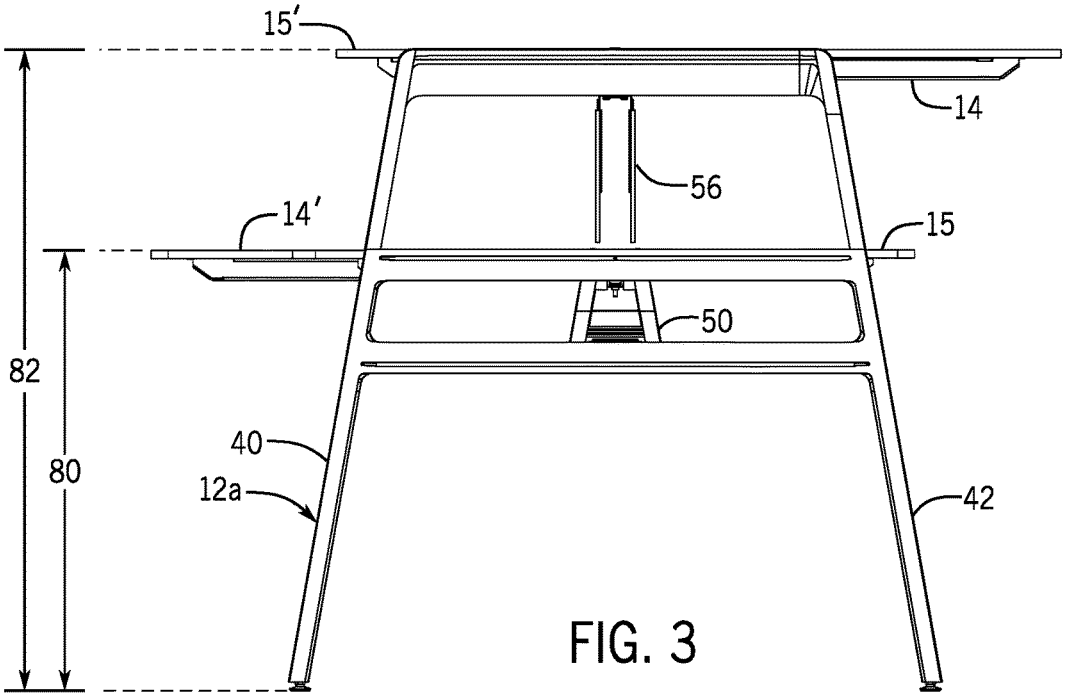
FIG. 3 is a side view of the multi-tiered work station of FIG. 1.

Referring now to the figures wherein like reference numerals correspond to similar elements throughout the several views and, more specifically, referring to FIGS. 1-3, an exemplary workstation desk/table assembly 10 with a multi-tiered work surface constructed in accordance with the present disclosure is shown. The multi-tiered workstation assembly 10 includes a substantially vertical mounting element 12, a first planar work surface 14 supported by the substantially vertical mounting element 12 at a first height, and a second planar work surface 15 supported by the mounting element 12 at a second height lower than the first height. As shown here, a first set of first and second work surfaces 14 and 15 can extend from one side of the vertical mounting element, and a second set of first and second work surfaces 14' and 15' can extend from the opposing side of the mounting element 12 to provide four work surfaces at two different heights. The work surfaces can, as shown here, be constructed with two different footprints, where 14 and 14' are constructed in one footprint and 15 and 15' in a second footprint, selected to enable access for a user from different heights when the surfaces are stacked. Each of the components in the assembly 10 will be described more fully below.

Figure 4:
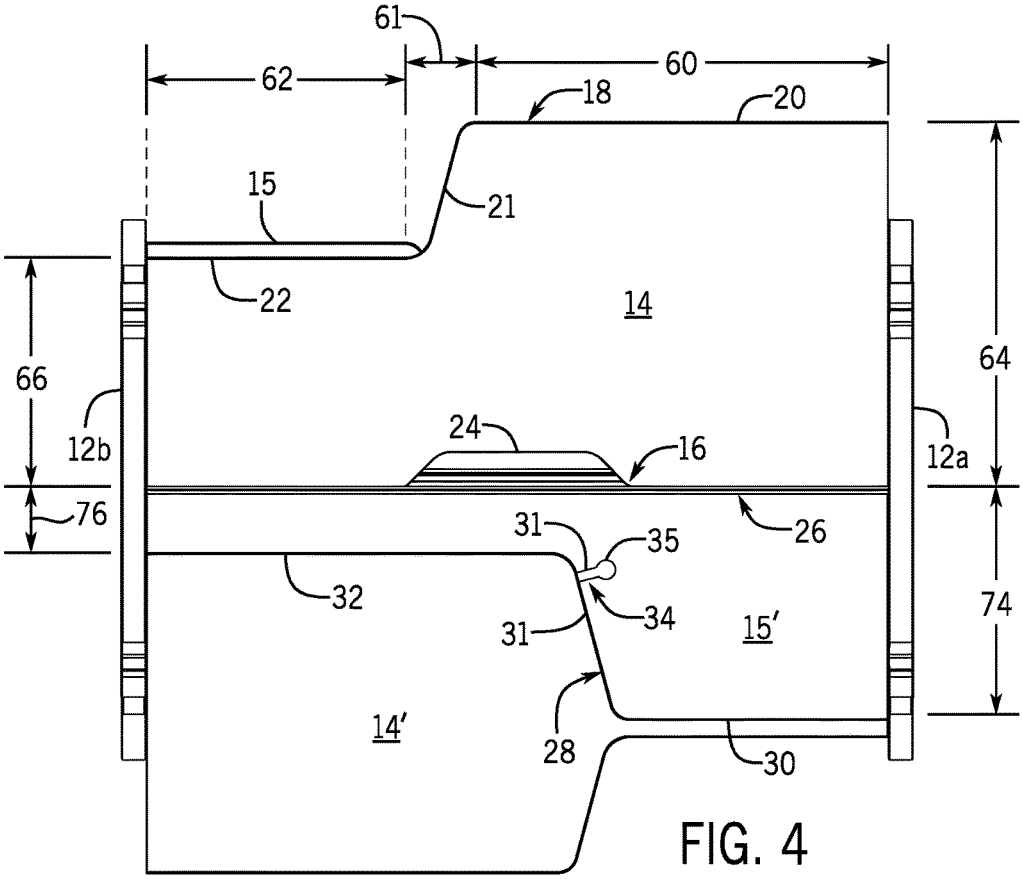
FIG. 4 is a top view of the multi-tiered work station of FIG. 1.

Referring still to FIGS. 1 through 3, and now also to FIG. 4, the first planar surface 14 has a first footprint that comprises a substantially straight inner edge 16 extending along a length dimension, and an opposing outer edge 18 comprising a wide end 20 and a narrow end 22. A width of the first planar work surface 14 is wider in the wide end 20 than the narrow end 22 in at least a portion of the surface 14. Referring still to FIG. 4, the wide end 20 can be joined to the narrow end 22 through a curved or angled edge portion 21. An opening 24 can be provided in the substantially straight edge 16 to enable routing of cables through the work surface 14, and to provide a grip for assembly and disassembly of the planar surface 14 in the workstation assembly 10. As shown in FIGS. 1-3, for example, the first planar work surface 14 can be selectively connected to the substantially vertical support 12 in either an upper position, at a standing height and above the second planar work surface 15, or in a lower sitting position, below the second planar work surface 15'.

Referring again to FIG. 4, the second planar surface 15' has a second footprint that also comprises a substantially straight inner edge 26 along a length dimension and an opposing outer edge 28 comprising a wide end 30 and a narrow end 32. Again, the width of the surface 15 between the straight inner edge 26 and the opposing outer edge 28 is wider in at least a portion of the wide end 30 than at least a portion of the narrow end 32. As shown here, an angled or curved edge portion 31 can join or connect the narrow end 32 and wide end 30. A channel 34 can be cut through the surface 15 to receive cables for computers, phones, tablets, speaker systems, printers, or other types of electronic devices. As shown here, the channel 34 is cut into outer edge 28, and includes a relatively narrow elongate channel adjacent the edge 31 and that open into a large circular opening 35 has been found to be advantageous to enable routing a cable. A grommet can be provided in the opening and the circular opening 35 acts as a catch for the end of a cord, preventing the cord from falling down from the surface, and helping to ensure that the cord is easily accessible. This configuration further enables a cable to be routed between two planar surfaces 14 and 15. In various embodiments, one or more channels similar to channel 34 may also be cut through the planar surfaces 14, 14', and/or 15'.

Referring now specifically to FIG. 4, as shown here, the length of the wide end 20 of the first planar work surface 14 is substantially identical to the length of the narrow end 32 of the second planar work surface 15 such that, when the planar work surfaces 14 and 15 are mounted to the substantially vertical mounting element 12 in a stacked configuration, the angled or curved portions 21 and 31 of the work surfaces 14 and 15 substantially align above one another. The wide end 20 of the first work surface 14 is supported above the narrow end 32 of the second surface 15, providing a work surface at a first height, which can be, as shown here, at a height selected specifically to accommodate a standing user (a "standing height"). The wide end 30 of the second planar surface 15 is supported beneath the narrow end 22 of the first planar surface 14, providing a work surface at a second height which can be, as shown here, a height selected specifically to accommodate a sitting user (a "sitting height"). Exemplary sitting or desk heights can, for example, include a range of 22-32 inches with 25-30 inches being more common and 29-30 inches being most common. Exemplary standing or counter work heights include a range of 25-48 inches with 38-42 inches being more common.

Referring still to FIGS. 1 through 3, in one embodiment, the substantially vertical mounting support 12 can include a first and a second substantially vertical mounting elements or 12*a* and 12*b*, respectively. The second substantially vertical mounting element 12*b* is offset a distance from the first substantially vertical mounting element 12*a*, and the first and second planar surfaces 14 and 15 extend at least partially between the substantially vertical mounting elements or leg members 12*a* and 12*b*. In general, the vertical mounting elements 12*a* and 12*b* are spaced apart to form a frame, and a frame space is formed between the mounting elements for receiving components of the work station 10.

Referring again to FIGS. 3 and 4, exemplary leg assembly 12*a* includes first and second generally vertical members 40 and 42, respectively, an upper horizontal rail member 44, middle horizontal rail 46, and a lower horizontal rail member 48. The rail members 44, 46, and 48 are secured to the vertical members 40 and 42 in a substantially horizontal configuration. A channel assembly 50 that includes a plurality of electrical receptacles, openings for passing power or data wires through the workstation assembly 10 and to the planar work surfaces 14 and 15, and knockout panels for adding additional functions is provided. The channel assembly 50 can also include clamping coupler assemblies or expansion jaw assemblies providing attachment features for attaching components. Details regarding the construction of the leg assemblies 12*a* and 12*b*, corresponding rail members 44, 46, and 48, and channel assembly 50 are found in U.S. Pat. Nos. 8,667,908 and 8,689,705, which are hereby incorporated by reference in their entireties for their disclosure of these devices, and related components and equipment. The channel assembly 50 further provides a rigid beam-like structure extending between leg assemblies 12*a* and 12*b* to support the lower work surfaces 15 and 14'.

Figure 5:
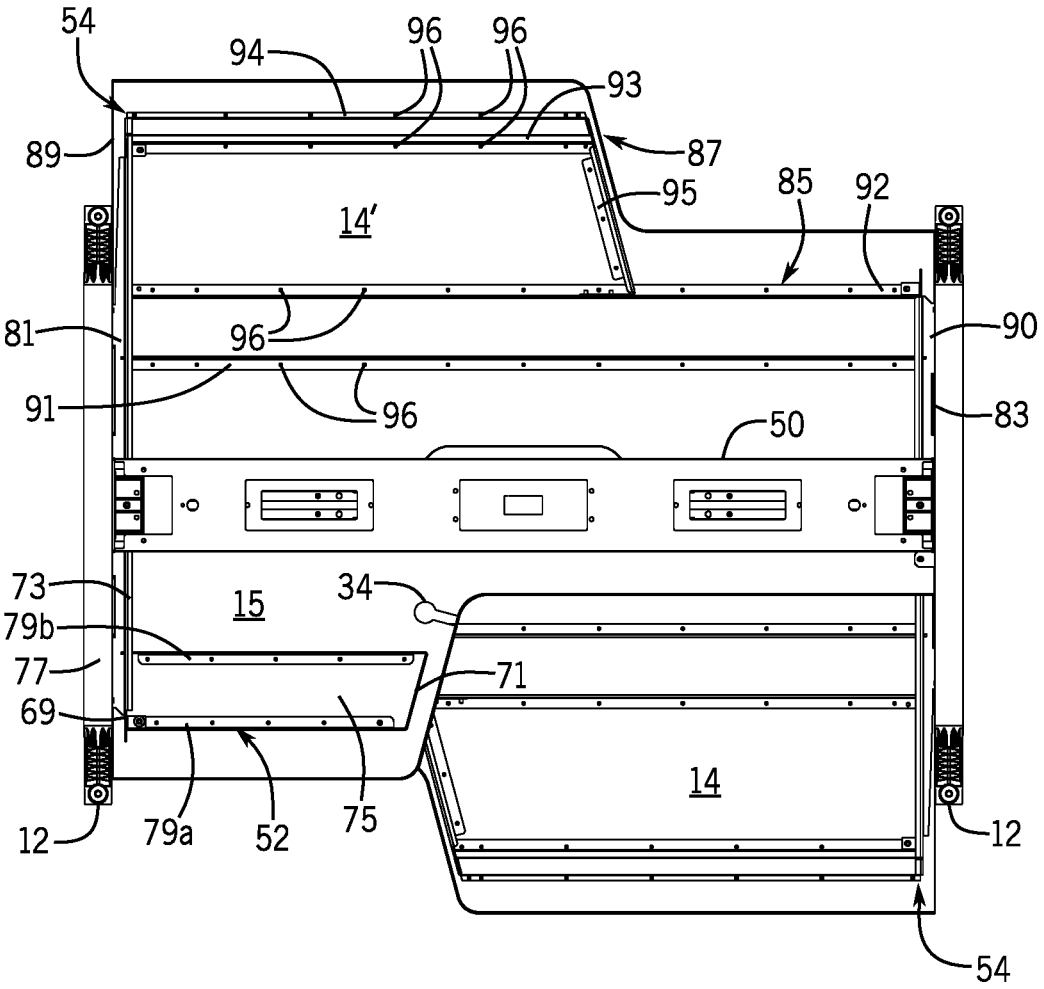
FIG. 5 is a bottom view of the multi-tiered work station of FIG. 1.
Figure 6:
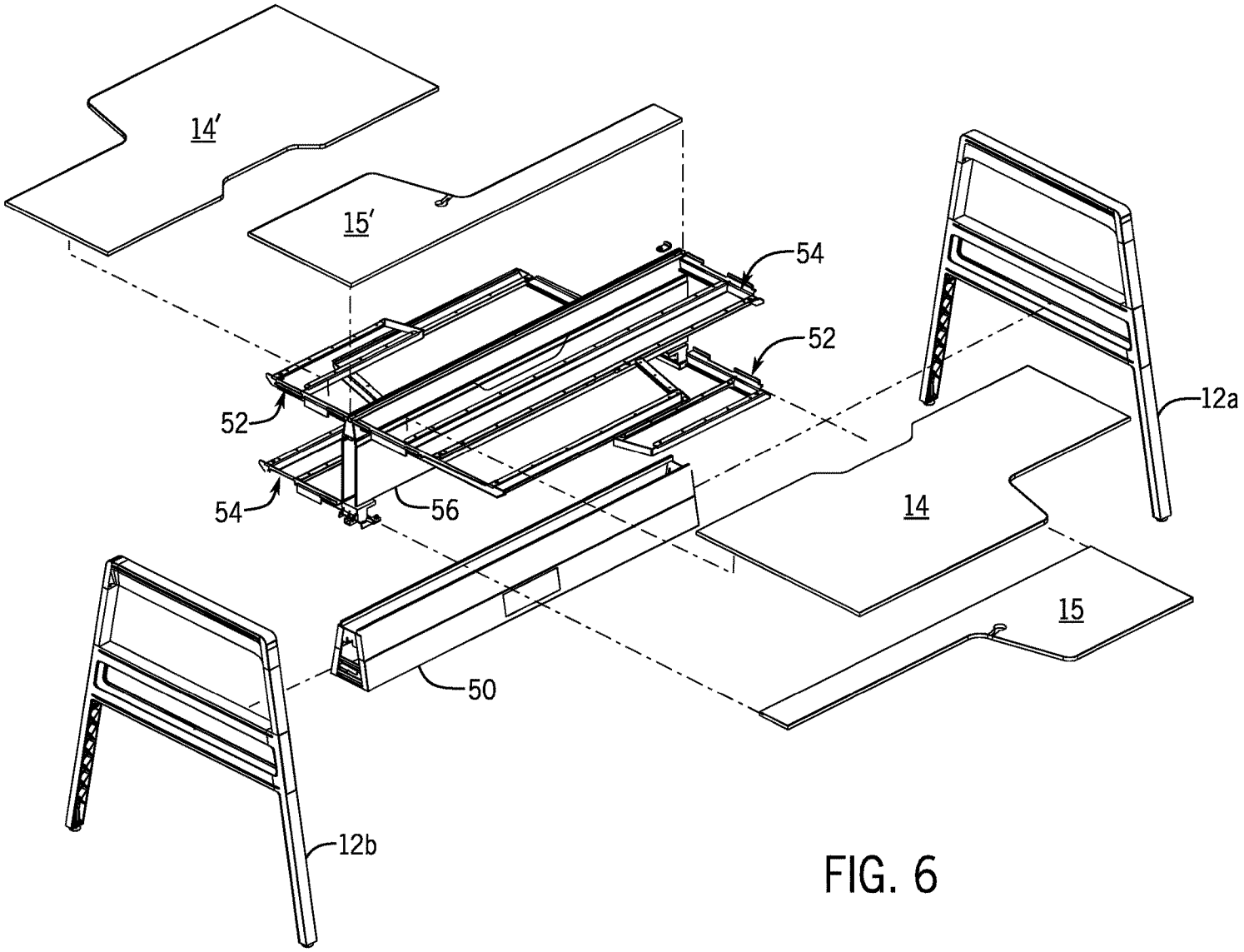
FIG. 6 is an exploded view of the multi-tiered work station of FIG. 1.

Referring now also to FIGS. 5 and 6, when assembled to a substantially vertical assembly 12 comprising leg assemblies 12*a* and 12*b*, of the type described above, the channel 50 is received between the lower horizontal rail 48 and the middle horizontal rail 46. A bracket 52 for receiving and supporting the second planar work surface 15 extends between the legs 12*a* and 12*b* at the height of the middle rail 46, and can be coupled to the channel 50. The bracket 52 extends from about the center of the rail 46 toward and extending beyond an adjacent edge of the rail 46, and provides a mounting location for supporting the second planar work surface 15 substantially at a sitting height. A second bracket 54 for receiving and supporting the first planar work surface 14 is coupled to the upper horizontal rail 44 at a standing height. The bracket 54, again, extends from about the center of the upper horizontal rail 44 toward and beyond an edge of the rail 44. The brackets 52 and 54, and other brackets described below, generally follow the perimeter shape of the planar work surface that is supported by the bracket. The brackets can be constructed from structural materials including metals, such as steel and aluminum, hard plastics, wood, and other materials that will be apparent to those of ordinary skill in the art. The brackets can be interconnected using fasteners such as screws, bolts, nails, or similar devices, but could also connected with adhesives, glues, welding, or other types of connections.

Referring still to FIGS. 5 and 6 a second set of brackets 52' and 54' for supporting planar surfaces 14' and 15' extend from about a center of the rails 44 and 46 in the opposite direction from the brackets 54 and 52 extending toward and beyond the outer edge of the corresponding rails. The third and fourth planar work surfaces 14' and 15' extend from the center of the rails 44 and 46, respectively, and in the opposite direction from the corresponding planar work surfaces 14 and 15. A channel assembly 56 extends between the upper horizontal rail 44 and middle horizontal rail 46, acting as a beam to support the upper work surfaces 14 and 15'. Cables can be routed through the channel assembly 56 for use on the upper work surfaces. The channel assembly 56 further provides the function of a privacy screen, essentially blocking the view through the workstation 10 between the planar work surfaces 15 and 14' mounted to the middle rail 46.

As best illustrated in FIG. 5, the first bracket 52 supports planar support surfaces 15 and 15' and includes a side rail 73 and a support plate 75. The side rail 73 extends parallel to and offset from the leg assembly 12 from the channel 50 along a wide end side edge 77 of the second planar work surface 15, terminating proximate the outer edge 28 on the wide end 30 of the second planar work surface 15. The support plate 75 includes parallel offset edges 79*a* and 79*b* extending along the length of the planar work surface and parallel to the channel 50, and side edge 69 and 71. Edge 79*b*, which is spaced closer to the channel 50, is longer than edge 79*a*, spaced adjacent the front edge of the work surface 15. Side edge 69 extends between and substantially perpendicular to edges 79*a* and 79*b* and parallel to leg 12. Edge 71 angles from the distal ends of edges 79*a* and 79*b*, offset from and substantially parallel to the perimeter edge of the curved edge portion 31. The support plate 75 therefore extends from the side rail 73 toward the curved edge portion 31, terminating proximate the curved edge portion 31. The opposing edges 79*a* and 79*b* of the support plate 75 are folded over to provide additional support.

The second bracket 54 supports planar work surfaces 14 and includes a plurality of rails, including generally side rails 81 and 85 and transverse rail assemblies 85 and 87. The side rails include a wide end side rail 81, and a narrow end side rail 83 sized and dimensioned to extend along the opposing edges of the planar support surface 15 adjacent legs 12*a* and 12*b*. Each of the wide end side rail 81 and the narrow end side rail 83 extends from the channel 50 along a wide end side edge 89 and a narrow end side edge 90 of the first planar work surface 14, respectively. The main transverse rail assembly 85 extends between the wide end side rail 81 and the narrow end side rail 83 across the length of the planar work surface 14 substantially parallel to the channel 50, and includes first and second parallel crossbars, comprising a first main crossbar 91 and a second main crossbar 92. Each of the first main crossbar 91 and the second main crossbar 92 is rigidly fixed on one end to the wide end side rail 81 and is rigidly fixed on another end to the narrow end side rail 83, with the first main crossbar 91 being disposed more proximate the channel 50 than the second main crossbar 92.

The transverse rail assembly 87 extends across the wide end of the work surface 14 and includes parallel first and second wide end crossbars 93 and 94, respectively. Each of the first wide end crossbar 93 and the second wide end crossbar 94 extends from the wide end side rail 81, toward the curved edge portion 21 of the work surface 14. An angled crossbar 95 extends between the transverse rail assemblies 85 and 87, where the angle of the angled crossbar 95 substantially follows the perimeter edge of the work surface 14 in the curved portion 21. The first wide end crossbar 93 is disposed more proximate the channel 50 than the second wide end crossbar 94. The angled crossbar 95 extends from an end of the second wide end crossbar 94, along the curved edge portion 21 of the planar work surface 14, terminating at the second main crossbar 92.

As illustrated, each of the first bracket 52 and the second bracket 54 is rigidly fixed to the second planar work surface 15 and the first planar work surface 14, respectively, using fasteners 96. The fasteners 96 can comprise nails, screws or any other suitable fasteners capable of coupling the respective brackets 52, 54 to their corresponding planar work surfaces 14, 15.

Referring now to FIGS. 7-11, an alternative exemplary workstation desk/table assembly 710 with a multi-tiered work surface constructed in accordance with the present disclosure is shown. The multi-tiered workstation assembly 710 is similar in construction to the multi-tiered workstation assembly 10, and as such, like features will be labeled similarly, in the 700 series (i.e. first planar work surface 14 and first planar work surface 714, first bracket 52 and first bracket 752). The differences between the multi-tiered workstation assembly 710 and the multi-tiered workstation assembly 10 will be described below. It should be noted that each of the multi-tiered workstation assemblies 10, 710 described herein are meant to be exemplary and are not meant to be limiting. As such, in many instances, features of the multi-tiered workstation assembly 10 may be combined or replaced with features of the multi-tiered workstation assembly 710, and vice-versa, as desired for a given situational requirement. These combinations are herein contemplated and are within the scope of the present disclosure.

Figure 7:
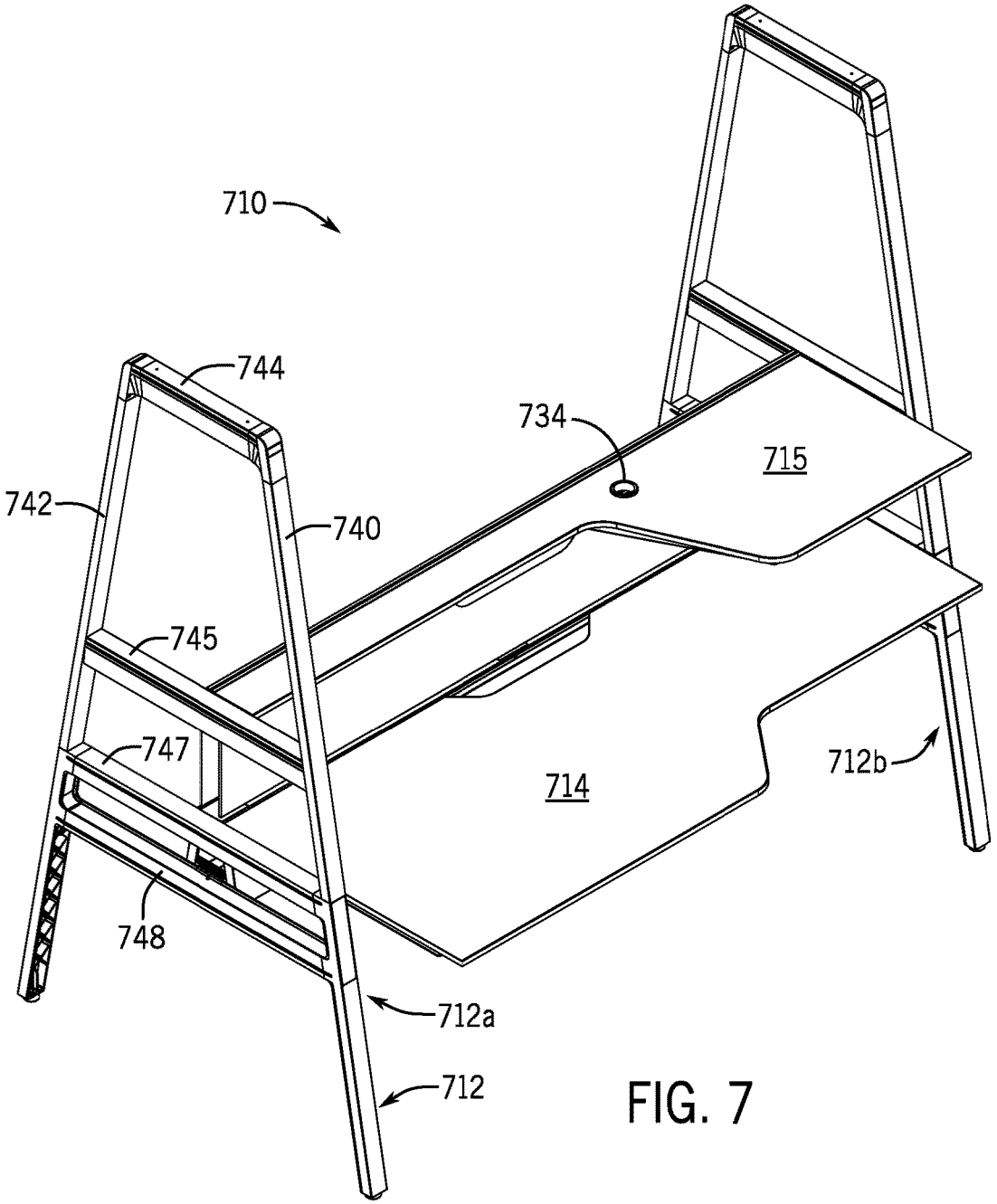
FIG. 7 is a side perspective view of a multi-tiered work station constructed in accordance with another embodiment of the disclosure.

Referring specifically to FIG. 7, the multi-tiered workstation assembly 710 includes a substantially vertical mounting element 712, a first planar work surface 714 supported by the substantially vertical mounting element 712 at a first height, and a second planar work surface 715 supported by the substantially vertical mounting element 712 at a second height. A hole 734, or alternative opening such as the channel described above, can be cut through the surface 715 to receive cables for computers, phones, tablets, speaker systems, printers, or other types of electronic devices. As shown here, the substantially vertical mounting support 712 includes first and second substantially vertical mounting elements 712*a* and 712*b*, respectively.

The exemplary leg assemblies 712*a* and 712*b* include first and second generally vertical members 740 and 742, respectively. However, as can be seen by comparison between FIGS. 1 and 7, in the embodiment of FIG. 7, the first and second generally vertical members 740 and 742 of the exemplary leg assemblies 712*a* and 712*b* are higher than the first and second generally vertical members 40 and 42 of the exemplary leg assemblies 12*a* and 12*b*, and include additional horizontal rails. As shown, the uppermost horizontal rail members 744 of the exemplary leg assemblies 712*a* and 712*b* are higher than the upper horizontal rail members 44. Additionally, the exemplary leg assemblies 712*a* and 712*b* include additional rail members, including an upper-middle horizontal rail 745 and a lower-middle horizontal rail 747, in addition to the lower horizontal rail member 748. The leg assemblies 712*a* and 712*b* can be mounted together in an assembly with other components as described in U.S. Pat.

Nos. 8,667,908 and 8,689,705, which are hereby incorporated by reference for their description of these devices and assemblies.

Figure 8:
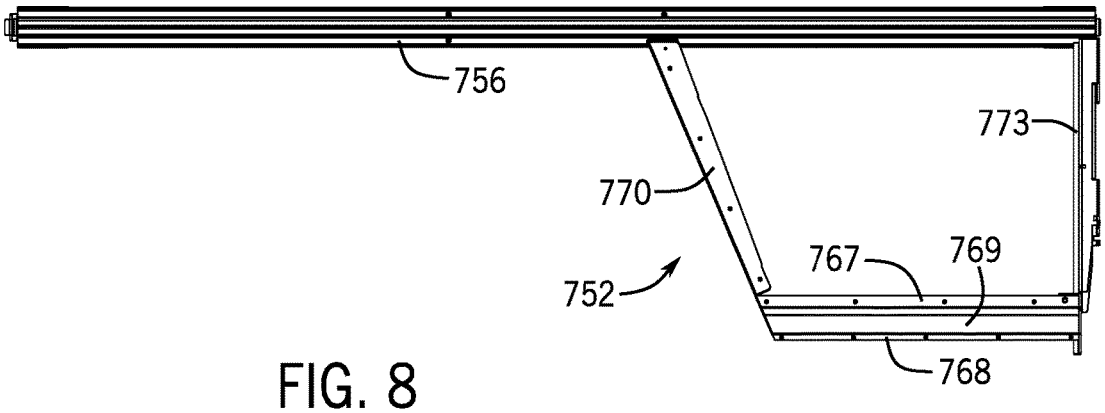
FIG. 8 is a top view of a first bracket of the multi-tiered work station of FIG. 7.
Figure 9:
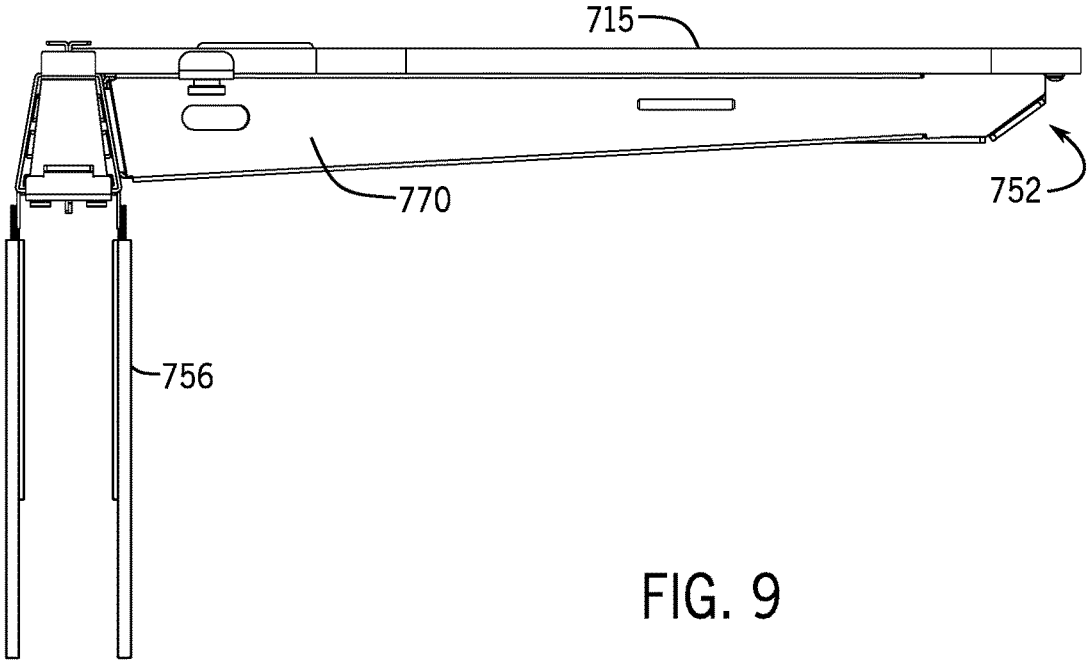
FIG. 9 is a side view of the first bracket of the multi-tiered work station of FIG. 7.

Referring now to FIGS. 8 and 9, the planar work surfaces 714 and 715 are supported by bracket assemblies 754 and 752. A specific embodiment is described below, however, these brackets generally follow the perimeter of the supported surface and can be constructed of rails and cross bars. In some applications support plates can also be used to add additional support. The brackets can interconnect with the central channel to ease assembly.

Referring to FIGS. 8 and 9, the planar work surface 715 is supported by a first bracket 752 that includes a plurality of rails arranged to follow the perimeter of the planar work surface 715, and that interconnects with the channel assembly 756. As shown here, the bracket 752 connects to the channel assembly 756, and includes a side rail 773 that is substantially perpendicular to the channel assembly 756, one or more front support rails 767 and 768 opposite from and substantially parallel to the channel assembly 756, and an angled rail 770 extending from the channel assembly 756 to the front support rails 767 and 768 at an angle parallel to the edge of the planar work surface 715. The first and second front support rails 767 are offset from and substantially parallel to one another. A support plate 769 can be coupled between the side rail 773, the first and second front support rails 767 and 768, and the angled rail 770. The angled rail 770 extends from an end of the first narrow rail 767 generally toward the channel assembly 756. The side rail 773 and angled rail 770 terminate at and couple to the channel assembly 756.

Figure 10:
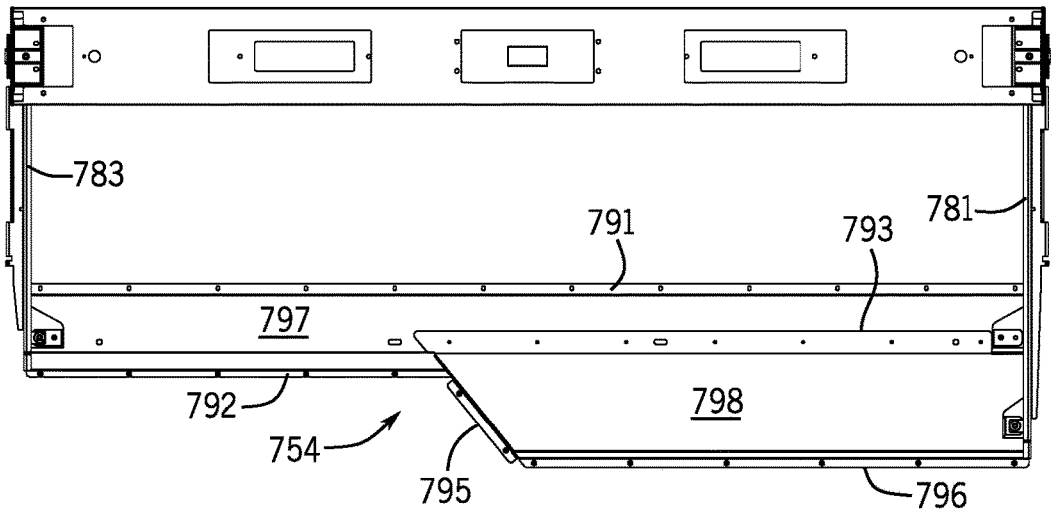
FIG. 10 is a bottom view of a second bracket of the multi-tiered work station of FIG. 7.
Figure 11:
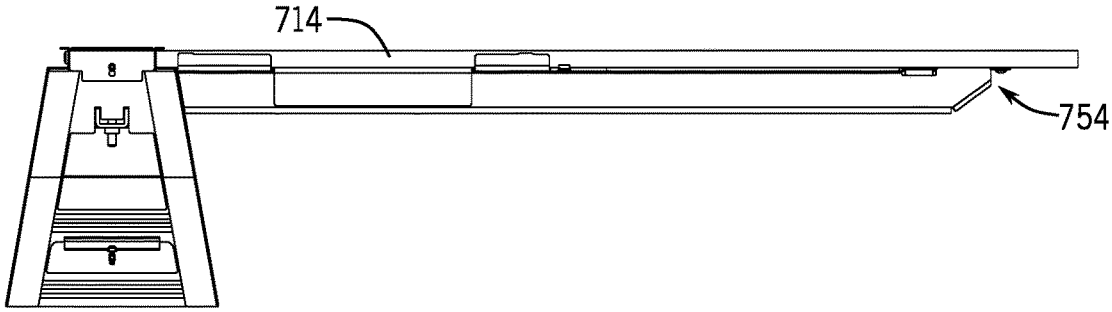
FIG. 11 is a side view of the second bracket of the multi-tiered work station of FIG. 7.

Referring now to FIGS. 10 and 11, the planar work surface 714 is supported by a second bracket 754 constructed of a plurality of rails or crossbars and plates arranged to follow the perimeter of and support the work surface 714. The second bracket 754 includes wide and narrow end side rails 781 and 783, respectively, and a transverse bracket assembly extending across the width of the work surface 714 between side rails 781 and 783, and comprising a plurality of rails or crossbars 791, 792, 793, 796, and support plate structures 797 and 798. Crossbars 791 and 792 and main support plate 797 can extend along the entire width of the work surface 714 between opposing side rails 781 and 783. Crossbar 792 can extend along the length of the narrow end of the work surface 714 proximate the edge opposite the channel 750, while crossbar 796 similarly extends along the length of the wide edge of the work surface 714. An angled crossbar 795 extends between an end of the crossbar 796 and an end of the crossbar 792, and is angled to follow the edge of the curved portion of the work surface 714. As illustrated, the main support plate 797 is coupled to and extends between the wide end side rail 781, the first main crossbar 791, the second main crossbar 792, and the narrow end side edge 783, opposite the first planar work surface 714. A wide end support plate 798 is coupled to and extends between the wide end side rail 781, the wide end crossbar 796, the second main crossbar 792, and the angled crossbar 795, opposite the first planar work surface 714. As shown, an additional crossbar 793 may be coupled to the opposing side of the wide end support plate 798.

Figure 12:
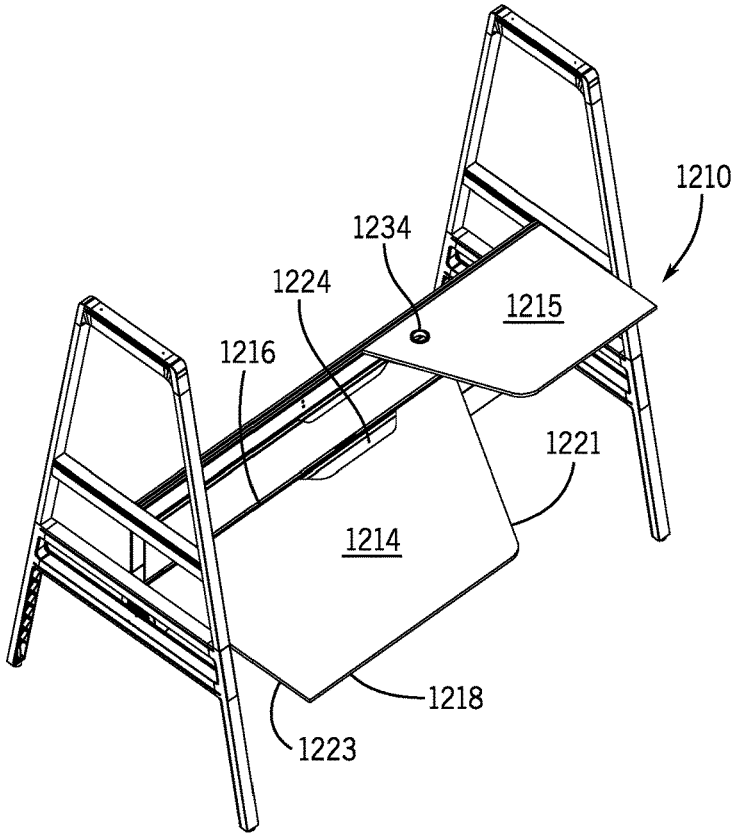
FIG. 12 is a side perspective view of a multi-tiered work station constructed in accordance with another embodiment of the disclosure.
Figure 13:
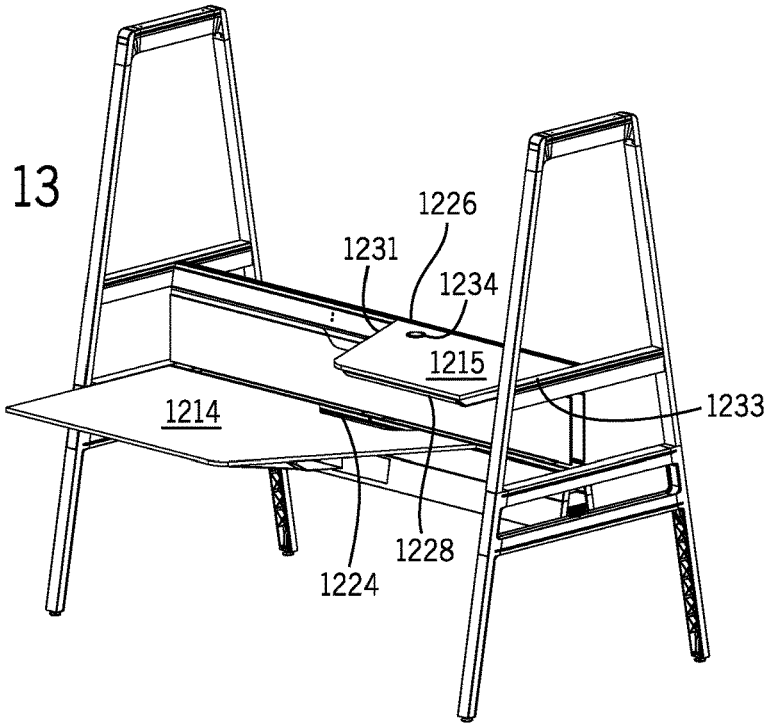
FIG. 13 is a side perspective view of a multi-tiered work station similar to FIG. 12.

Referring now to FIGS. 12 and 13, another alternative exemplary workstation desk/table assembly with a multi-tiered work surface 1210 constructed in accordance with the present disclosure is shown. As described above, features of the multi-tiered workstation assembly 1210 may be combined or replaced with features of the multi-tiered workstation assemblies described above as desired for a given situational requirement. These combinations are herein contemplated and are within the scope of the present disclosure.

As shown in FIGS. 12 and 13, the work surfaces 1214 and 1215 extend along a portion of the distance between the leg assemblies 712*a* and 712*b*, rather than along the entire length as described with reference to the embodiments discussed above. These work surfaces can be used together in a single assembly as shown, or with the work surfaces, and can also be used as shelving. Brackets such as bracket 752, described above, which substantially follow the perimeter of the supported work surface and which connect directly to an inner channel, can be used to support these work surfaces.

The work surface 1214 includes a substantially straight inner edge 1216 and an opposing outer edge 1218 that is shorter than the inner edge. The side 1223 adjacent the leg is substantially perpendicular to each of the inner edge and outer edge 18, while the interior side edge angles or curves between these edges through a curved or angled edge portion 1221. An opening 1224 can be provided in the substantially straight edge 1216 to enable routing of cables through the work surface 1214, and to provide a grip for assembly and disassembly of the planar surface 1214 in the workstation assembly 1210.

Referring still to FIGS. 12 and 13, the surface 1215 extends only a portion of the distance between the leg assemblies 712*a* and 712*b*. An inner edge 1226 is received in the channel, and the opposing outer edge 1228 is substantially parallel to the inner edge, but is smaller in a length dimension. As shown here, an outer side edge 1233 is substantially perpendicular to each of the sides 1226 and 1228, while an interior side edge 1231 is angled or curved between edges 1226 and 1228. A hole 1234, channel, or other opening can be cut through the surface 1215 to receive cables for computers, phones, tablets, speaker systems, printers, or other types of electronic devices.

Now that the various components of the multi-tier workstation assemblies 10, 710, and 1210 have been described above, an exemplary method of assembling the multi-tier workstation assembly 10 is described below. It will be appreciated that the following method of assembly is meant to be exemplary and is therefore in no way meant to be limiting. It will also be understood by those skilled in the art that the following description, which is given in reference to the multi-tier workstation assembly 10, can similarly be applied to the multi-tier workstation assembly 710.

To assemble the multi-tier workstation assembly 10, a planar work surface 14 or 15 is coupled to a substantially vertical mounting element 12 in a substantially horizontal orientation at a first height, which can be, as discussed above, a sitting or a standing height. The planar work surface 14 or 15 comprises a substantially straight edge 16, 26 along a length dimension. An opposing edge 18, 28 comprises a wide end 20, 30 and a narrow end 22, 32. A second, similarly constructed planar surface 14 or 15 is coupled to the substantially vertical mounting element 12 in a substantially horizontal orientation at a second height. The wide end 20, 30 of the first surface 14, 15 is mounted to be supported above the narrow end 22, 32 of the second surface 15, 14, and the wide end 20, 30 of the second planar surface 15, 14 is mounted to be supported beneath the narrow end 22, 32 of the first planar surface 14, 15. The first planar surface therefore provides a work surface at the wide end accessible to a user at the first height, which can be, for example, a standing height, and the second planar surface provides a work surface at the wide end accessible to a user at the second height, which can be a sitting height. A second set of similar work surfaces can be provided on the opposing side. Although two heights are described, variations in both the number of surfaces and the heights are contemplated.

Referring still to FIGS. 1-6, and specifically to FIG. 4, in one embodiment, the workstation 10 comprises stacked work surfaces 14 and 15, where the planar work surface 14 has a different footprint than the planar work surface 15, and where the footprints are selected to enable stacking of the work surface having the first footprint above another work surface having the second footprint, while a space between the upper work surface and the floor is at least partially unobstructed by the lower work surface to allow access. As shown in the figures, in one embodiment, the work surfaces 14 and 15 are equivalent in length and have similar shapes. The work surface 14, however, is larger in the depth dimension at both the wide end 20 and narrow end 22 than the corresponding wide end 30 and narrow end 32 of the planar work surface 15.

In one specific embodiment that has shown to advantageously provide access to users simultaneously accessing both sitting and standing height work surfaces, the work surface 14 is about 58 inches in total length. The wide end 20 has a length dimension 60 of about thirty-two and one quarter inches, the length dimension 62 of the narrow portion 22 of the work surface 14 is about twenty and one quarter inches, and the angled or curved edge portion 21 has a length dimension 61 of about five and one half inches in length. The depth dimension 64 in the wide end 20 is about twenty-five inches, while the depth dimension 66 in the narrow end 22 is about seventeen and three quarter inches.

The length of the work surface 15 is, again, about 58 inches. The length dimension of the wide end 30 of the work surface 15 is substantially the same as the length dimension of the narrow end 32 of the work surface 15, while the narrow end 32 has a length dimension that is substantially equivalent to the length dimension 60 of the wide end 20 of the planar surface 14. The angled or curved edge portions 21 and 31 of each of the planar surfaces 14 and 15 each have a length dimension 61 of about five and one half inches in length. In the depth dimension, the wide end 30 has a depth dimension 74 of about eighteen inches, while the narrow end 32 has a depth dimension 76 of about four and three-quarters inches.

Referring now also to FIG. 4, in the specific embodiment described above, a height dimension 80 between an underlying floor surface and a planar surface 14 or 15 mounted to the horizontal middle rail 46 is at a "sitting height" of about twenty-eight and a half inches, while the "standing height" height dimension 82 between the floor surface and the upper rail 44 work surface is about forty-one and a half inches.

A workstation assembly 10, as described above, can also be provided as a kit for constructing a multi-tiered work surface. The kit can include, for example, a substantially vertical mounting element providing access points for coupling work surfaces at two or more heights, at least a first and a second planar surface, each comprising a straight edge along a length dimension and an opposing edge comprising a wide end and a narrow end. The first planar surface is adapted to be coupled to the substantially vertical mounting element at a first height and the second planar surface is adapted to be coupled to the substantially vertical mounting surface at the second height such that the wide end of the first planar surface overhangs the narrow end of the second planar surface, and the narrow end of the first planar surface overhangs the wide end of the second planar surface, providing a work surface at the first height and the second height. Brackets can also be included for mounting the work surfaces, as well as a channel for cable management and electrical distribution. The workstation assembly 10 can also be mounted together in an assembly with other components described in U.S. Pat. Nos. 8,667,908 and 8,689,705, which are incorporated herein by reference for their descriptions of such devices.

Although a specific embodiment has been shown and described, it will be apparent that variations can be made within the scope of the disclosure. For example, although a substantially vertical mounting element comprising a frame constructed of pairs of offset legs has been described above, it will be apparent that other types of vertical mounting structures could also be used. For example an upright post with rails mounted to the post could be used in place of a leg structure. Alternatively, the planar surfaces could be mounted directly to a post, or a frame system including opposing legs and beams running between the beams could also be used.

Additionally, although each of the embodiments shown above is double sided, a single-sided construction that includes work surfaces extending from one side only is also contemplated. Further, although the footprint for the work surfaces described above comprises a wide end that is offset from the center, such that one side of the assembled work station is longer than another, the wide end and the narrow end of each of the first and second planar surfaces 14 and 15 can also be substantially equivalent in length. Although an arced or angled segment is described as joining the wide and narrow ends of the work surfaces 14 and 15, it will be apparent that these segments can be joined at a ninety degree angle, angled in an alternate direction, or curved. Further, although substantially rectangular work surfaces result from the footprint described, square, angled, and rounded work surfaces could also be provided in different types of footprints.

Although a privacy screen is described extending between the middle and upper horizontal rails 46 and 44, a privacy screen can also extend between the adjacent upper work surfaces at a standing height, providing a privacy shield between a first side of the multi-tiered work surface and a second side of the multi-tiered work surface.

Although a rail system is described for mounting the work surfaces, it will be apparent that other types of mounting elements can be used. The mounting elements could, for example, include pre-defined mounting points for coupling the first and second planar surfaces at the corresponding first and second heights, and that vertical mounting elements that include any number of predetermined mounting points can also be provided. The height of the work surfaces can, therefore, be selected or adjusted for the height of a user.

Although one specific embodiment with defined dimensions is described above, other embodiments having different dimensions in similar ratios will also be advantageous. These dimensions, further, are not intended to be limiting.

Thus, the invention is to cover all modifications, equivalents, and alternatives falling within the spirit and scope of the invention as defined by the following appended claims.

To apprise the public of the scope of this invention, the following claims are made:

What is claimed is:

1. A multi-tiered work surface, comprising:

a substantially vertical mounting element;

a first planar surface supported by the substantially vertical mounting element in a substantially horizontal orientation at a first height, the first planar surface comprising a substantially straight edge along a length dimension and an opposing edge comprising a wide end and a narrow end along a depth dimension, a width in at least a portion of the wide end being greater than a width in at least a portion of the narrow end;

a second planar surface supported by the substantially vertical mounting element in a substantially horizontal orientation at a second height lower than the first height, the second planar surface comprising a substantially straight edge along a length dimension and an opposing edge comprising a wide end and a narrow end along a depth dimension, a width in at least a portion of the wide end being greater than a width in at least a portion of the narrow end, the wide end of the first surface supported above the narrow end of the second surface, the wide end of the second planar surface being supported beneath the narrow end of the first planar surface, and the narrow end of the second planar surface being supported beneath the wide end of the first planar surface;

wherein the first planar surface provides a work surface at the wide end accessible to a user at the first height, and the second planar surface provides a work surface at the wide end accessible to a user at the second height.

2. The multi-tiered work surface of claim 1, further comprising a second substantially vertical mounting element, the second substantially vertical mounting element being offset a distance from the substantially vertical mounting element, and the first and second planar surfaces extending at least partially between the vertical mounting element and the second vertical mounting element.

3. The multi-tiered work surface of claim 1, further comprising a third and a fourth planar surfaces, each of the third and fourth planar surfaces comprising a substantially straight edge and an opposing edge comprising a wide end and a narrow end wherein at least a portion of the wide end is greater in width than at least a portion of the narrow end, wherein the third planar surface is supported by the vertical mounting element at a third height and the fourth planar surface is supported by the vertical mounting element at a fourth height, the wide end of the third planar surface extending above the narrow end of the fourth planar surface, wherein the third planar surface provides a work surface at the wide end accessible to a user at the third height and the fourth planar surface provides a work surface at the wide end accessible to a user at the fourth height.

4. The multi-tiered work surface of claim 3, wherein the substantially straight edge of the first planar surface coupled to the vertical mounting element faces the substantially straight edge of the third planar surface coupled to the vertical mounting element, and the straight edge of the second planar surface coupled to the vertical mounting element faces the substantially straight edge of the fourth planar surface coupled to the vertical mounting element.

5. The multi-tiered work surface as recited in claim 4, further comprising a substantially vertical planar surface extending between the first and third planar surfaces, the vertical surface providing a privacy shield between a first side of the multi-tiered work surface and a second side of the multi-tiered work surface.

6. The multi-tiered work surface of claim 1, wherein the wide end and the narrow end of each of the first and second planar surface are substantially equivalent in length.

7. The multi-tiered work surface of claim 1, wherein the first planar surface comprises an arced segment extending between the wide end and the narrow end.

8. The multi-tiered work surface as recited in claim 1, wherein the substantially vertical mounting element comprises a pre-defined mounting point for coupling the first and second planar surfaces at the corresponding first and second heights.

9. The multi-tiered work surface as recited in claim 1, wherein the vertical mounting element comprises a first horizontal rail corresponding to the first height and a second horizontal rail corresponding to the second height.

10. The multi-tiered work surface as recited in claim 1, wherein the first height is a sitting height and the second height is a standing height.

11. The multi-tiered work surface as recited in claim 1, wherein the substantially vertical mounting element comprises a plurality of pre-determined mounting points at a corresponding plurality of heights.

12. An arrangement with multi-height work surfaces comprising:

a leg arrangement configured to be supported on a ground surface, the leg arrangement comprising a first attachment feature at a first height above the ground surface and a second attachment feature at a second height above the ground surface, where the second height is greater than the first height;

a first work surface coupled to the first attachment feature and having a first footprint relative to the ground surface; and a second work surface coupled to the second attachment feature and having a second footprint relative to the ground surface;

wherein the first footprint and the second footprint are distinct; and wherein the space between the floor and the second work surface is at least partially unobstructed by the first work surface, and wherein a wide portion of the second footprint is adapted to stack above a narrow portion of the first footprint, and a narrow portion of the second footprint is adapted to stack above a wide portion of the first footprint, wherein access to the wide portion of each of the first and second work surfaces is unobstructed for use.

13. The arrangement of claim 12, wherein the second work surface is co-planar with a top surface of the leg arrangement.

14. The arrangement of claim 12, wherein the first height is selected to be at a height for using the first work surface while sitting.

15. The arrangement of claim 12, wherein the second height is selected to be at a height for using the second work surface while standing.

16. The arrangement of claim 12, further comprising a second leg arrangement with a third attachment feature at the first height above the ground surface and a fourth attachment feature at the second height above the ground, wherein the first work surface is coupled to the third attachment feature and the second work surface is coupled to the fourth attachment feature.

17. A multi-height work arrangement comprising:

a frame comprising a first leg assembly, a second leg assembly, an upper support beam and a lower support beam both extending between the first leg assembly and the second leg assembly;

a standing height work surface coupled to at least the first leg assembly and the upper support beam, the standing height work surface having a length running adjacent the upper support beam; and a sitting height work surface coupled to at least the second leg assembly and the lower support beam, the sitting height work surface having a length running adjacent the lower support beam;

wherein a depth of the standing height work surface is greatest adjacent the first leg assembly and a depth of the sitting height work surface is greatest adjacent the second leg assembly, and wherein the standing height work surfaces comprises a wide end and a narrow end, and the sitting height work surface comprises a wide end and a narrow end, the wide end of the standing height work surface being substantially equivalent in length to the narrow end of the sitting height work surface.

18. The multi-height work arrangement of claim 17, further comprising a bracket assembly for supporting each of the standing height and the sitting height work surfaces, the bracket assembly coupled at a first end to a channel assembly extending between the first and second leg assemblies, and comprising a sitting height bracket assembly that follows the perimeter of the sitting height work surface and a standing height bracket assembly that follows the perimeter of the standing height work surface.

* * * * *